US006568955B2

(12) United States Patent
Hotea et al.

(10) Patent No.: US 6,568,955 B2
(45) Date of Patent: May 27, 2003

(54) ELECTRICAL CONNECTOR FOR FLEXIBLE PRINTED CONDUCTORS

(75) Inventors: Gheorghe Hotea, Griesheim (DE); Claudius Rieder, Frankfurt (DE); Josef Woller, Griesheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 09/993,006

(22) Filed: Nov. 16, 2001

(65) Prior Publication Data

US 2002/0081883 A1 Jun. 27, 2002

(30) Foreign Application Priority Data

Nov. 20, 2000 (DE) ..... 100 57 401

(51) Int. Cl.[7] ..... H01R 12/24

(52) U.S. Cl. ..... 439/495; 439/260; 439/862; 439/856; 439/857

(58) Field of Search ..... 439/495, 260, 439/680, 862, 857, 856, 701

(56) References Cited

U.S. PATENT DOCUMENTS 4,629,271 A * 12/1986 Awano ..... 439/260
5,727,968 A * 3/1998 Ito ..... 439/495
6,056,572 A * 5/2000 Matsumoto et al. ..... 439/260
6,332,801 B1 * 12/2001 Watanbe ..... 439/409

* cited by examiner

*Primary Examiner*—Tho D. Ta

(57) ABSTRACT

The present invention relates to an electrical connector which at least partially receives a foil with printed conductors embedded therein, and comprises an insulating housing with an insertion aperture for the foil and at least one foil contact with a contact section for contacting the printed conductors. The foil contact has a connection section for connection to an electric component and an actuating zone to receive mechanical pressure. To ensure reliable contacting and inexpensive production and simplified assembly of the components, the foil contact is bent as one piece from a punched spring sheet and has at its first contact arm an end section which is bent approximately to a U-shape, which can be brought into contact with the two contact arms by mechanical pressure. According to the invention, the connector also comprises an actuator to actuate this foil contact in which retaining webs are integrally formed which penetrate the foil when the actuator is closed. Finally, a connector is proposed in which the housing comprises a connector part and a collar part separated therefrom.

19 Claims, 25 Drawing Sheets

106
A–A
A
A
216
206
208
212
204
220
212
220
226
216
215C
215B
215A

ELECTRICAL CONNECTOR FOR FLEXIBLE PRINTED CONDUCTORS

FIELD OF THE INVENTION

The present invention relates to an electrical connector for flexible flat cable or flexible printed circuit boards.

BACKGROUND OF THE INVENTION

Typical electrical connectors for flexible flat cables (FFC) or flexible printed circuit boards (FPC) comprise an insulating or dielectric housing having an insertion aperture for the foil with printed conductors embedded therein. A plurality of foil contacts is mounted in the housing along this insertion aperture. The foil contacts are substantially arranged parallel to one another. Contact sections of these foil contacts are arranged in the insertion aperture in such a way that they can contact conductive areas of the foil cable. The housing also often comprises an actuator (pressure clamp) which can be moved from an "open" state in which the foil can be inserted into the insertion aperture, into a "closed" state in which the foil and the connections thereof are pressed against the contact region of the foil contact.

Many of the above-described electrical connectors for FFC/FPC foils are designed in such a way that the foil can be inserted with zero insertion force. When the actuator is in the "open" position then the foil can be pushed into the insertion aperture without using force. If the actuator is then closed the foil is grasped and the printed conductors of the foil are pressed against the contact sections of the foil contact.

However, electrical connectors of this type often exhibit defective electric connections or electric connections which are susceptible to faults as the foil can slip during assembly or operation.

One potential application of these electrical connectors is in the motor vehicle electronics sector where, because the extremely harsh environmental conditions the electric contact has to satisfy very high requirements, in particular in relation to resistance to vibration and corrosion but also thermal stability and current handling capability. Furthermore, the electrical connector should be inexpensive to produce and be able to be miniaturised as far as possible.

European patent specification EP 0 696 090 B1 describes an electrical connector for flexible printed circuit boards which is assembled on a further printed circuit board. The connector comprises a housing with an insertion aperture and a plurality of contact elements which are arranged in the housing in such a way that spring contact components of the contact elements project into the insertion aperture. A bearing region is provided on the contact element. An actuator which can be rotated on the bearing region from an open position into a closed position, has a pressure edge which, when the actuator is moved into the closed position, moves in the direction opposite to the insertion direction of the foil and presses the foil against the spring contact component. In this way, the electric connections between the foil and the contact elements are produced.

A connector for printed circuit boards, in particular for flexible printed circuit boards such as FPC or FFC, is the subject of the European patent application EP 0 926 778 A2. The connector has an insulating housing with a groove which is open at the top and base contacts which are arranged in the housing at regular intervals and each have a resilient bar and an integral arm adjoining thereto. Each bar has a conductive projection which protrudes into the groove and each arm, which extends along the top of the housing into the groove, has a pivotal end opposing the projection. An insulated press-on cover engaging in the pivotal ends can be rotated between a closed position close to the projections and an open position remote from the projections. The pivotal ends lock the cover and press the flexible printed circuit board against the resilient bars. The cover comprises cover contacts which rotatably engage in the pivotal ends and correspond with the base contacts, so the pivotal ends, the covering contacts and the flexible printed circuit contact one another electrically when the cover is closed.

A further electrical connector for flat circuits is described in the European Patent Publication EP 0 966 070 A1. The connector comprises a dielectric housing with an insertion aperture and a plurality of electrical connections which are mounted in the housing and are arranged along the insertion aperture. The connections have contact regions in order to contact the printed conductors of the flat circuit. An actuator is movably mounted on the housing and changes its position between an open position in which the foil can be inserted and a closed position in which the foil and its printed conductors can be pressed against the contact regions of the connections. Only some of the connections comprise restraining connections with gripper elements which grip and fix the flat circuit when the actuator is open. Other connections do not contain any restraining elements, so the foil can be inserted here without insertion force.

Finally, U.S. Pat. No. 4,082,402 discloses a connecting terminal for a crimp connection when connecting flexible printed conductors. The connecting terminal is designed in such a way that it penetrates the insulating sheath of the flexible printed conductor and surrounds the printed conductor in order to provide both a mechanical and electrical connection thereto. The connecting terminal has two pairs of sharp teeth located opposite one another which after penetration of the foil are bent with respect to one another in such a way that they surround the printed conductor and electrically contact it. In an electrical connector for flexible flat cable which uses a plurality of connecting terminals of this type both the electric contacting and the tension relief of the flexible foil are therefore ensured by the sharp teeth of the connecting terminal.

All these connectors exhibit the drawback that, on the one hand, their production is very complex and therefore expensive and, on the other hand, that contacting of the foil printed conductor is not reliable enough under extreme environmental conditions.

SUMMARY

An object of the present invention therefore is to provide an electrical connector for a foil with printed conductors embedded therein which ensures reliable contacting and, moreover, permits inexpensive production and simplified assembly of the component.

The present invention relates to an electrical connector which at least partially receives a foil with printed conductors embedded therein, and comprises an insulating housing with an insertion aperture for the foil and at least one foil contact with a contact section for contacting the printed conductors. The foil contact has a connection section for connection to an electric component and an actuating zone to receive mechanical pressure. To ensure reliable contacting and inexpensive production and simplified assembly of the components, the foil contact is bent as one piece from a punched spring sheet and has at its first contact arm an end section which is bent approximately to a U-shape, which can be brought into contact with the two contact arms by mechanical pressure. According to the invention, the connector also comprises an actuator to actuate this foil contact in which retaining webs are integrally formed which penetrate the foil when the actuator is closed. Finally, a connector is proposed in which the housing comprises a connector part and a collar part separated therefrom.

BRIEF DESCRIPTION OF THE DRAWINGS

The invention will be described in more detail hereinafter with the aid of the preferred embodiments shown in the attached drawings, in which:

FIG. 23 is a perspective view of the collar part with an inserted foil contact;

DETAILED DESCRIPTION OF THE PREFERRED EMBODIMENT

Figures 1A, 1B:
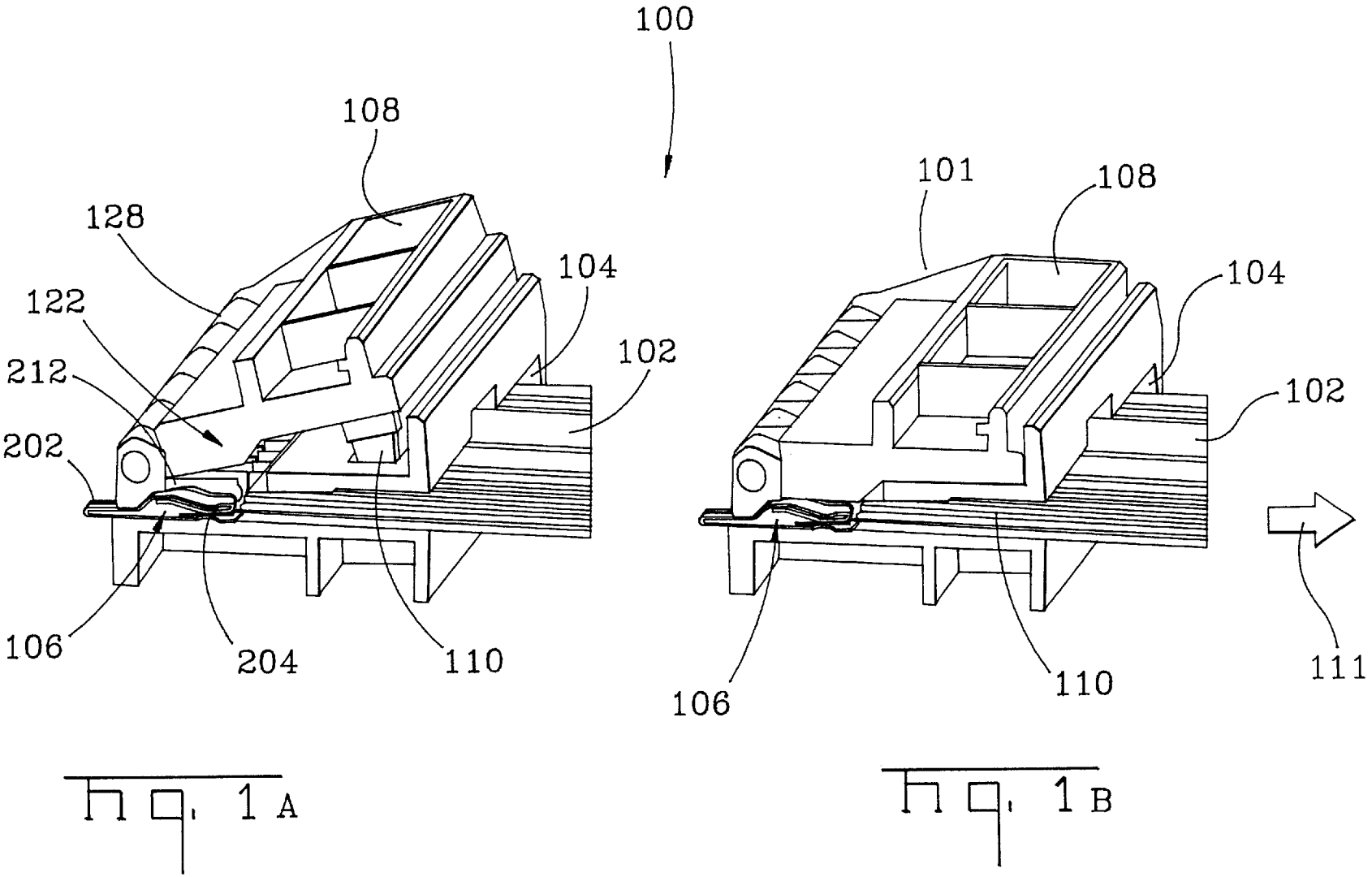
FIGS. 1A and 1B are perspective views of an electrical connector during assembly and in the assembled state.

Preferred embodiments of the invention will be described in more detail hereinafter. Similar or corresponding details of the subject according to the invention are provided with the same reference numerals.

Electrical connectors according to the present invention are required in order to produce a defined connection between a flexible flat cable (FFC) or a flexible printed circuit board (FPC) and another electronic component. This electronic component can, for example, be an integrated circuit, a printed circuit board or a further electric cable. Depending on the nature of this electronic component, the electric contact of the connector is detachable for example in the form of a connector sleeve arrangement or non-detachable such as a soldered joint.

As shown in FIG. 1 the electrical connector 100 has an insulating housing 101 which comprises an insertion aperture 104 for a foil 102 with flexible printed conductors embedded therein, and at least one foil contact 106 with a contact section 204 for contacting the printed conductors, a connection zone 202 for connection to an electric component and an actuating zone 212 to receive mechanical pressure. This mechanical pressure is provided by a pressure web 122 which is formed on an actuator 108. For introduction of the foil 102, the actuator 108 pivotally mounted at a hinge 128 is opened so that the pressure web 122 does not touch the actuating zone 212 of the foil contact 106. In this state as shown in FIG. 1A, the foil contact 106 is relaxed in a contact section 204, so the foil 102 may be inserted without insertion force. If the actuator 108 is now rotated in the direction of the foil contact 106, as shown in FIG. 1B, the pressure web 122 comes into contact with the actuating zone 212 of the foil contact 106 and compresses the foil contact. As is to be shown even more clearly in the following figures, the mechanical pressure exerted on the actuating zone 212 of the foil contact 106 by the pressure web 122 firmly clamps the foil in the contact section of the foil contact. At the same time, retaining webs 110, which are also formed on the actuator 108, penetrate the foil 102 to guard against the tensile force 111 exerted on the foil.

Figure 2:
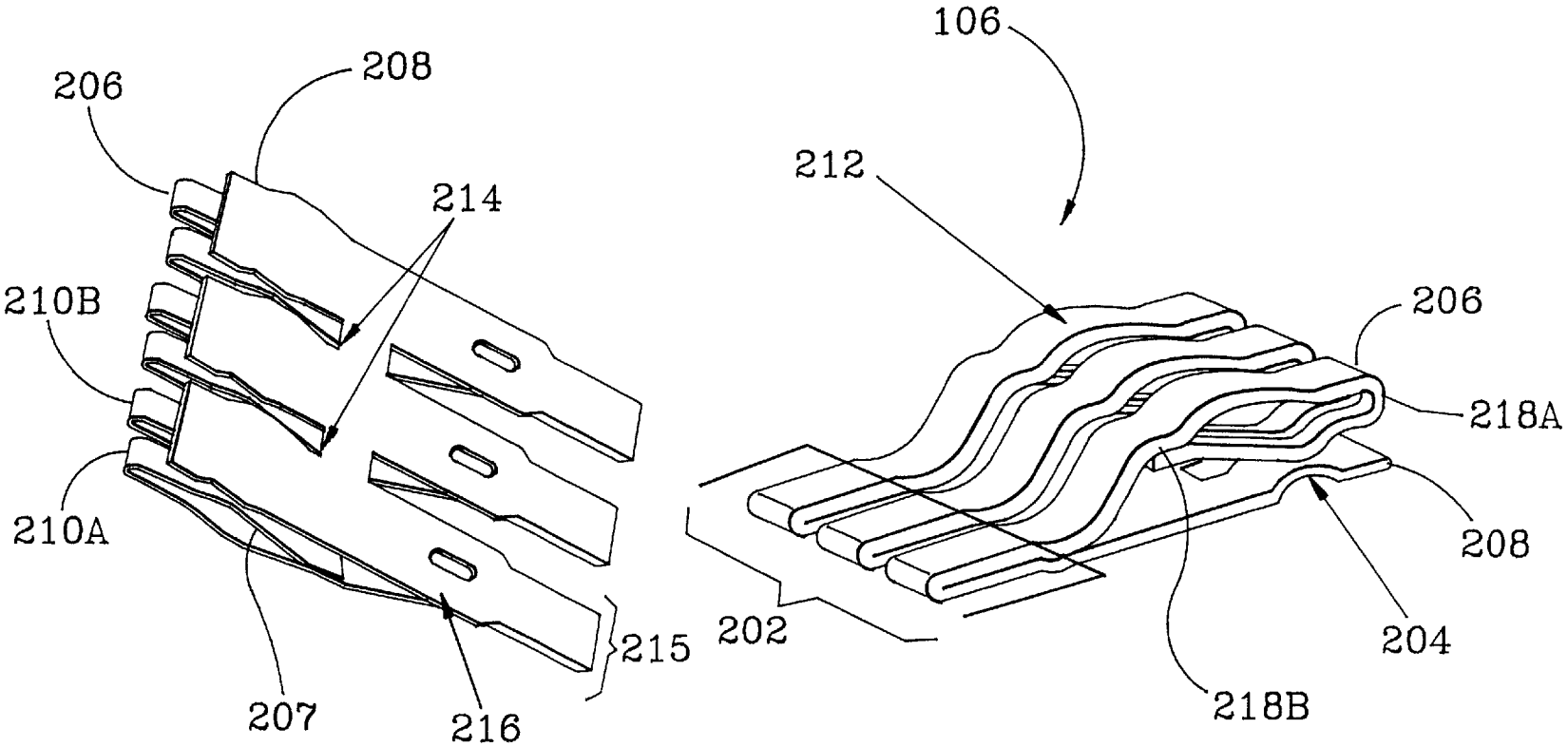
FIG. 2 shows various perspective views of a foil contact according to the invention.

FIG. 2 shows two perspective views of a foil contact 106. For contacting of the foil printed conductor the foil contact has a contact section 204. The foil is inserted between the first and second contact arm 206 and 208 respectively. The foil contact 106 is produced from a sheet of metal by stamping and forming and is shaped in such a way that an end portion 207 of the first contact arm 206 is bent so as to be substantially U-shaped and is in contact with the first contact arm at two connection points 218. Mechanical pressure exerted on the actuating zone 212 therefore causes, on the one hand, the entire first contact arm 206 to be bent downwards and is, furthermore, forwarded via the two connection points 218*a* and 218*b* to the contact section 204. The foil contact in the development according to the invention moreover forms a double spring 207 and 212 which makes an open gap size and a constant spring characteristic curve possible. The connection zone 202 which produces a connection to a further electronic component is located at the end of the foil contact 106 opposite the contact section 204. In the embodiment shown here this connection zone 202 is designed as a soldered zone. The second contact arm 208 has an aperture in the vicinity of the connection zone 202 in which a corresponding locking latch on the housing engages and fixes the foil contact 106 in the housing 101. The foil contact 106 is composed of a plurality (in this FIG. 2, for example, three) contact elements 215 which are connected to one another by separable contact bridges 214. The first contact arm 206 is divided into two contact webs 210A and 210B owing to a slot provided in the end portion 207 of the first contact arm.

Figure 3:
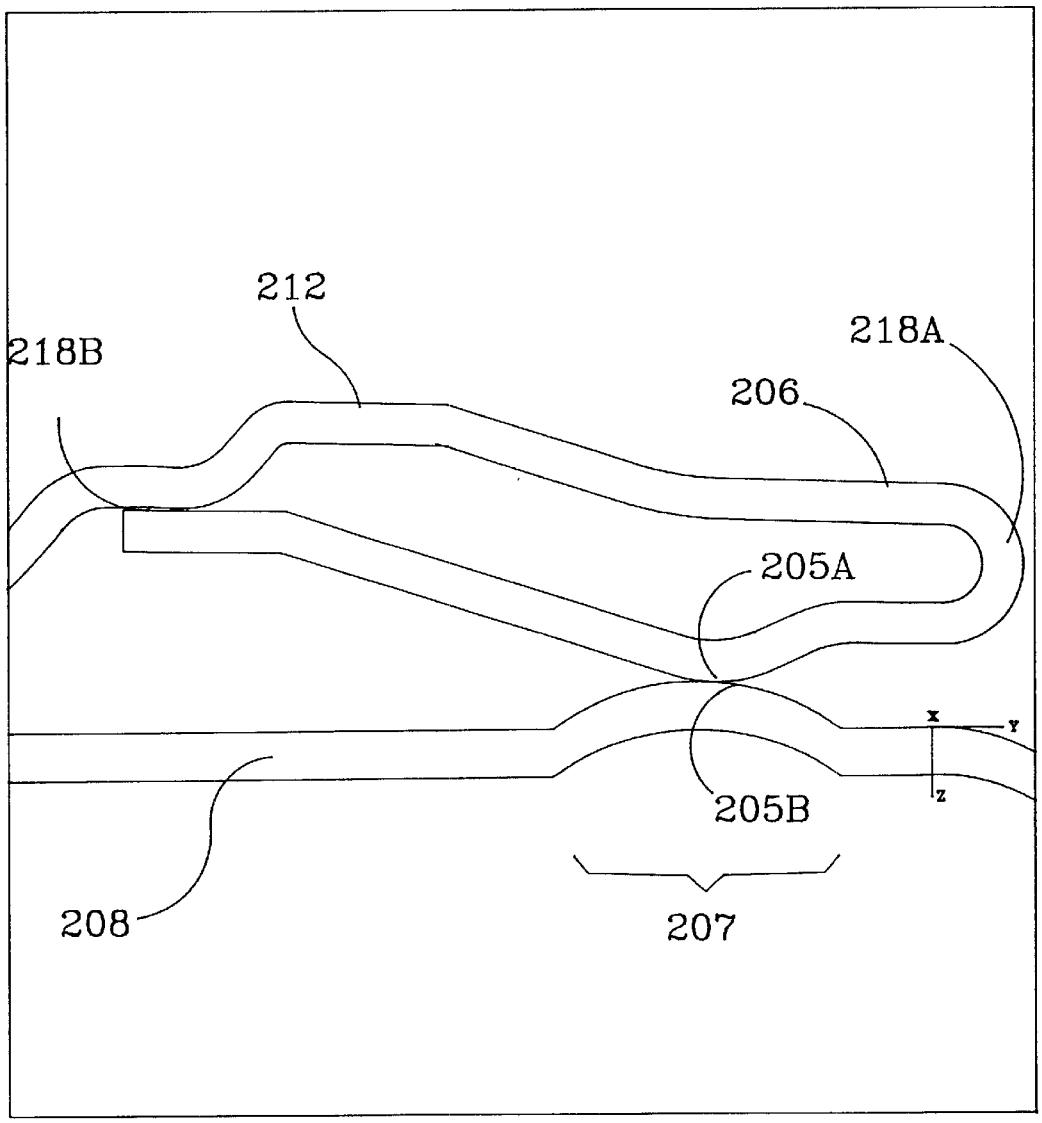
FIG. 3 is a section through the foil contact according to the invention in the relaxed state.
Figure 4:
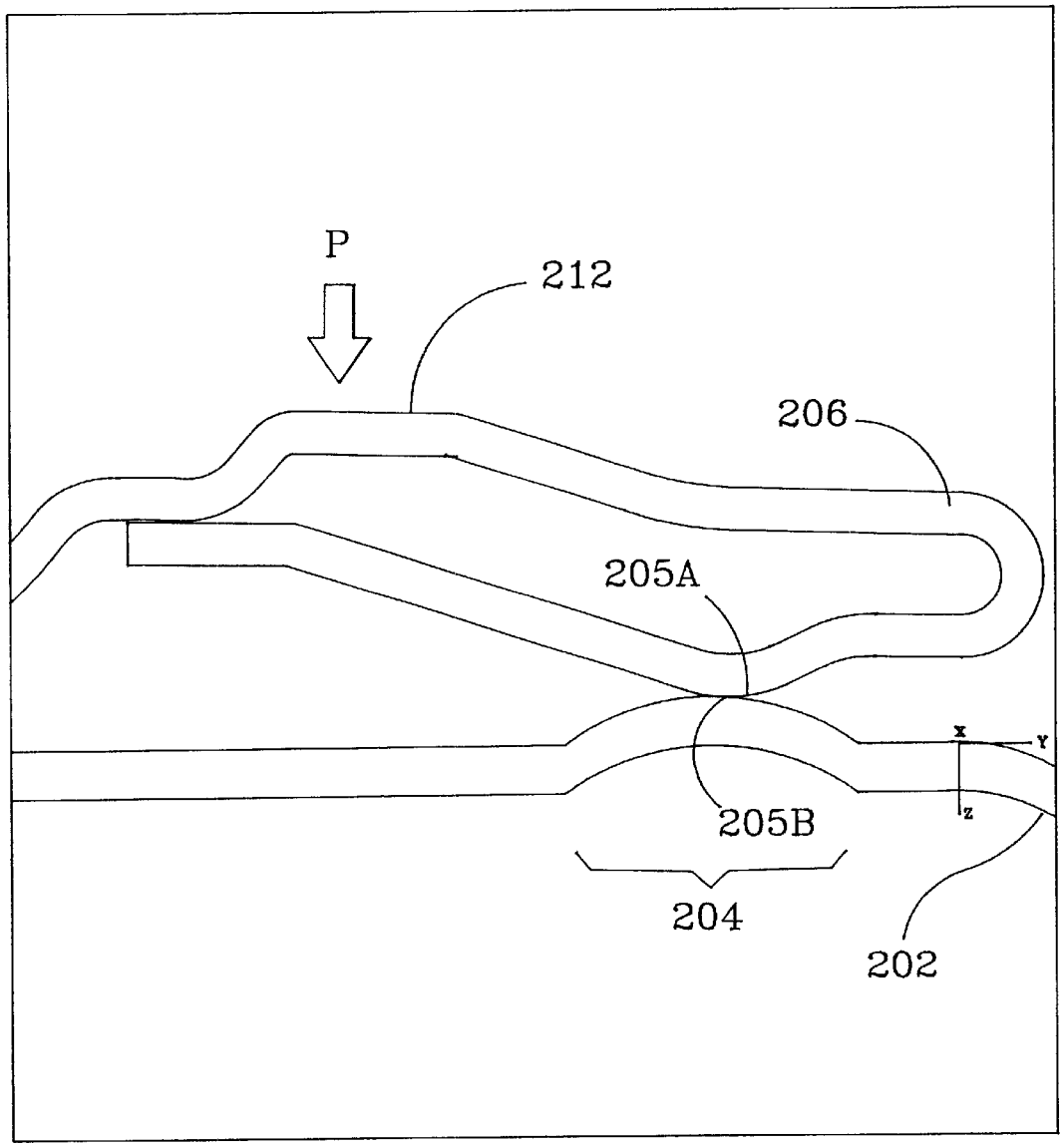
FIG. 4 is a section through the foil contact according to the invention in the compressed state.
Figure 5:
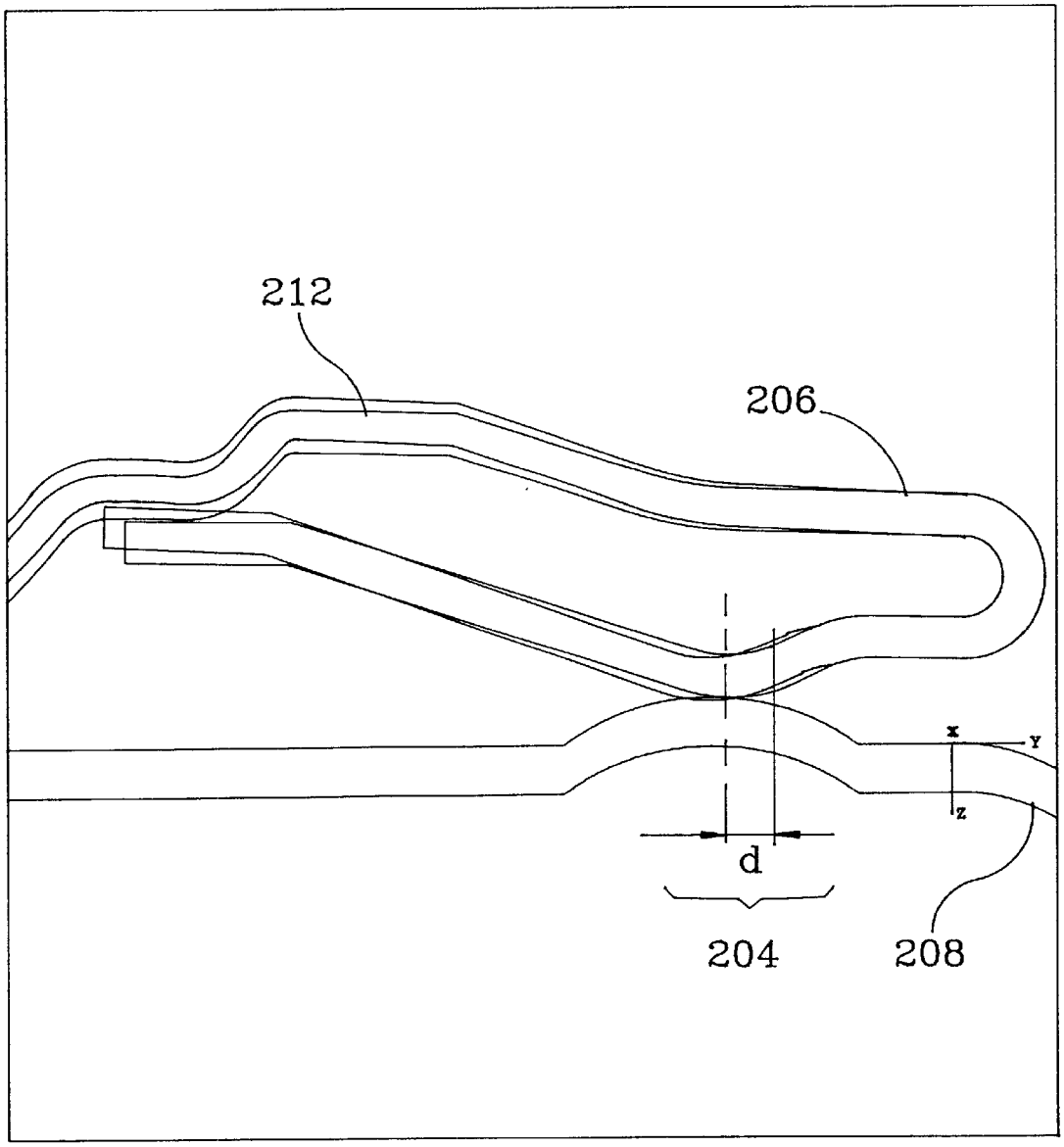
FIG. 5 is a superimposition of the sectional drawings in FIGS. 3 and 4.

FIG. 3 shows a section through the foil contact 106 in the region of the contact section 204. No mechanical pressure acts on the actuating zone 212 here, so a foil (not shown) can be inserted without expenditure of force between the two contact points 205A and 205B. If mechanical pressure P is now exerted on the actuating zone 212 then the first contact arm 206 is deformed. The two contact points 205A and 205B are pressed onto one another or a foil is pressed between them. This compressed state of the foil contact 106 is shown in FIG. 4. In FIG. 5 the two sectional diagrams of FIGS. 3 and 4 have been precisely superimposed. It can be seen that owing to the first contact arm 206 having been compressed via the mechanical pressure P exerted on the actuating zone 212 the first contact point 205A is displaced by the distance d in the Y direction in addition to a displacement in the Z direction. Such a movement in the Y direction causes the contact point 205A to rub either on the contact point 205B if the foil contact 106 is actuated without inserted foil or on the printed conductor of the inserted foil 102. Residues on the contact surfaces, which can impair the quality of the electric contact, can be effectively removed in this way.

Figure 6:
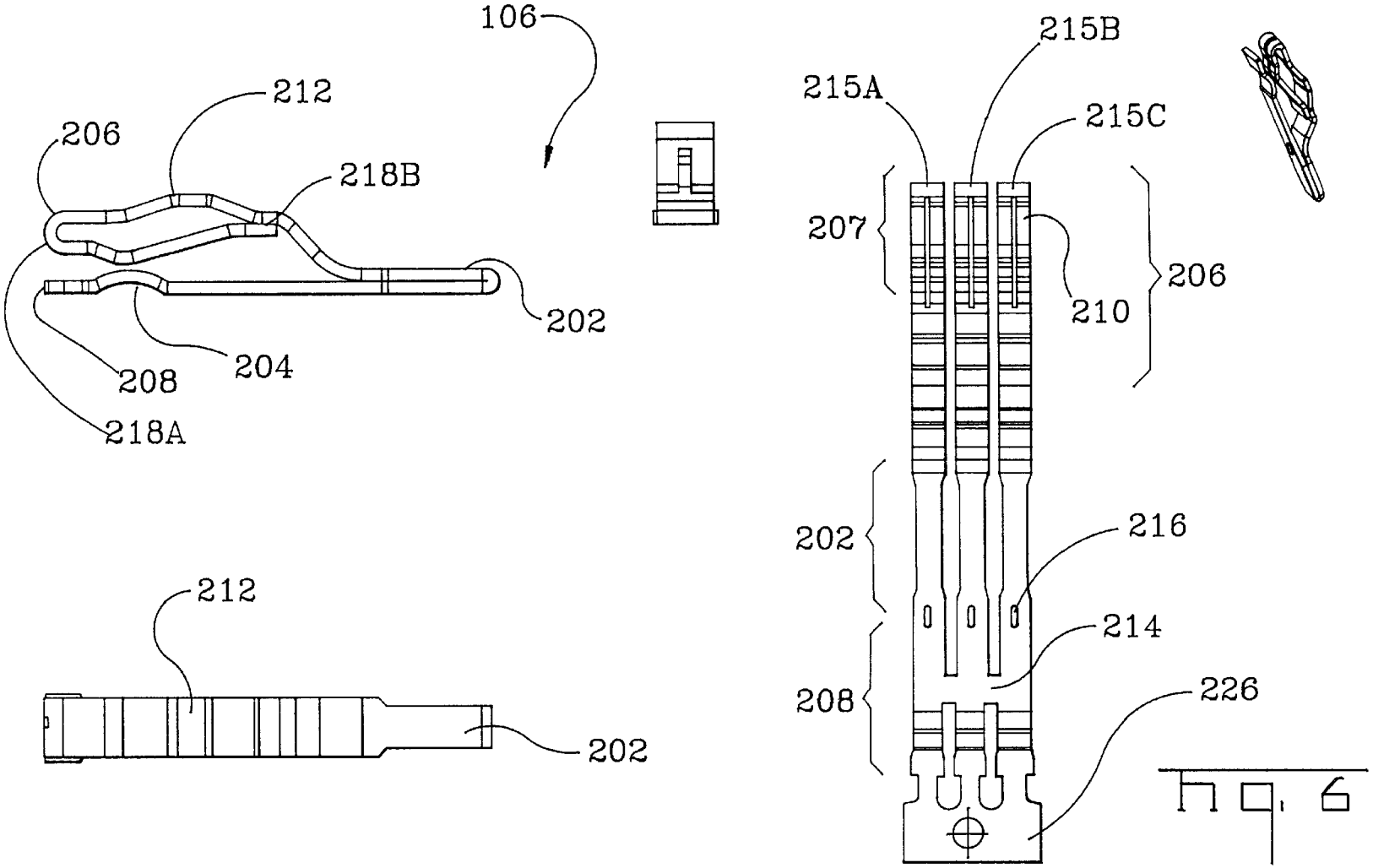
FIG. 6 shows various views of a foil contact according to a first preferred embodiment.

FIG. 6 shows various views of the foil contact 106 according to a first embodiment in the bent and unbent state. A punched eye strip 226 is removed once the foil contact is completed.

Figure 7:
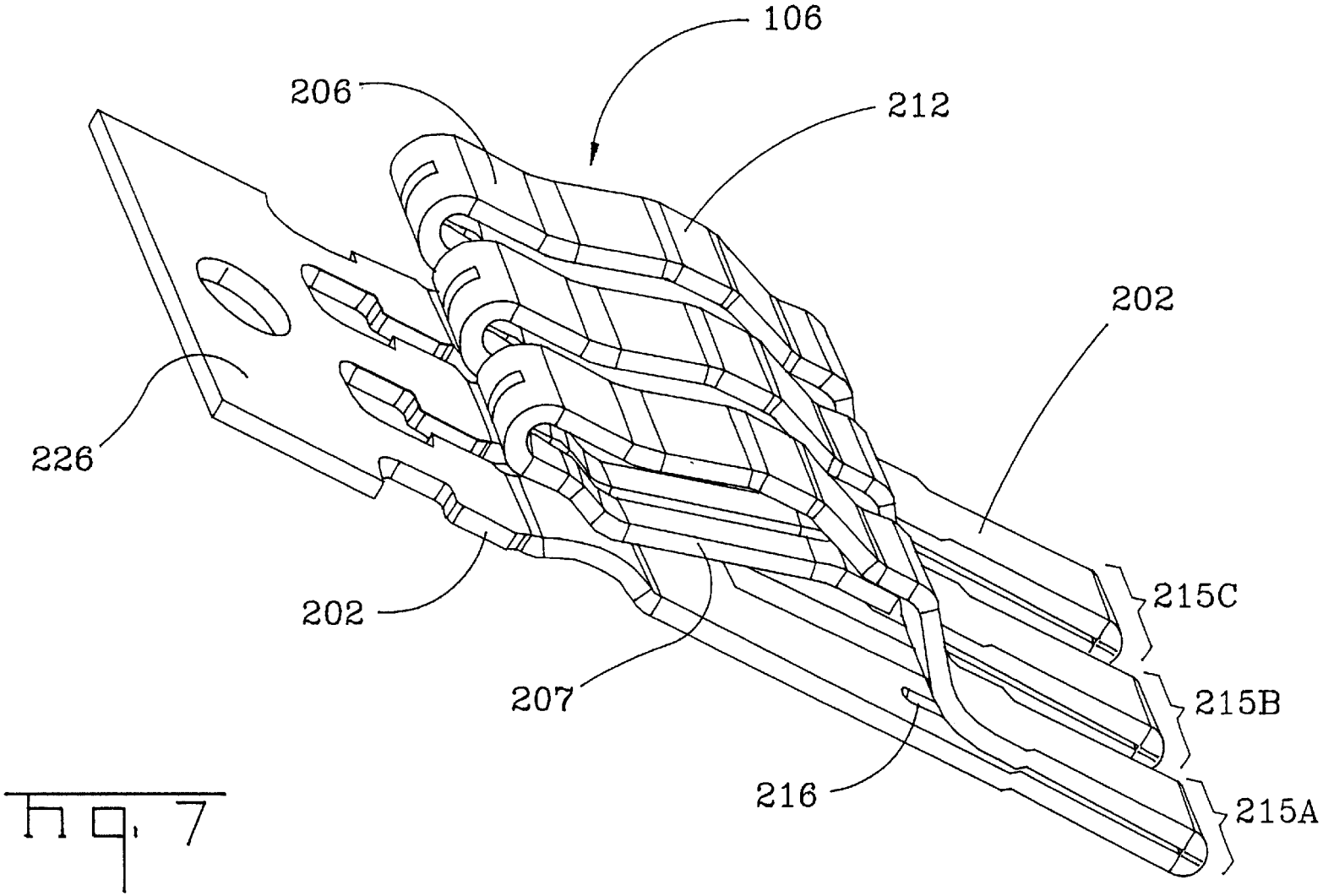
FIG. 7 is a perspective view of the foil contact according to the first preferred embodiment.
Figure 8:
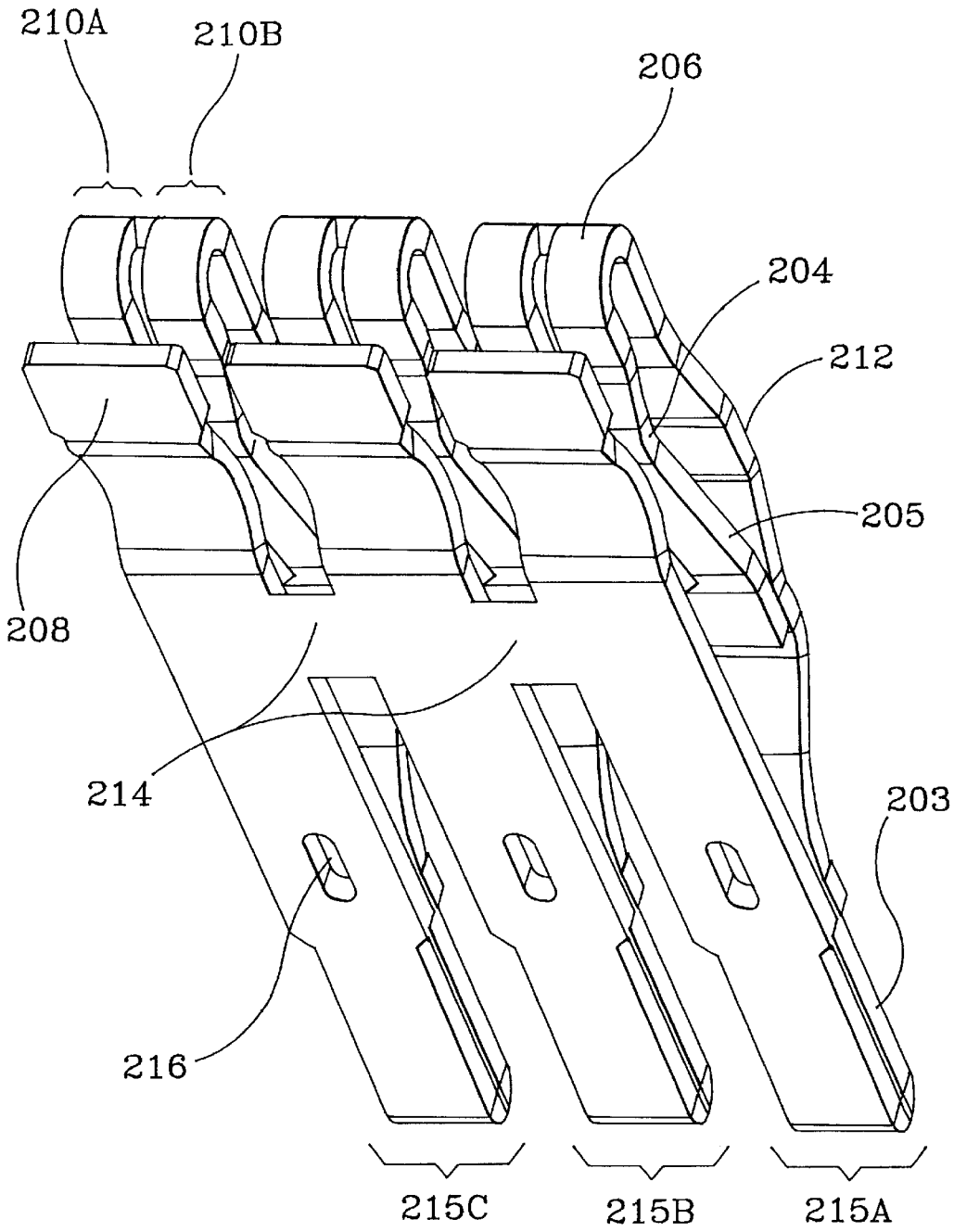
FIG. 8 is a perspective view of the foil contact according to the first preferred embodiment.
Figure 9:
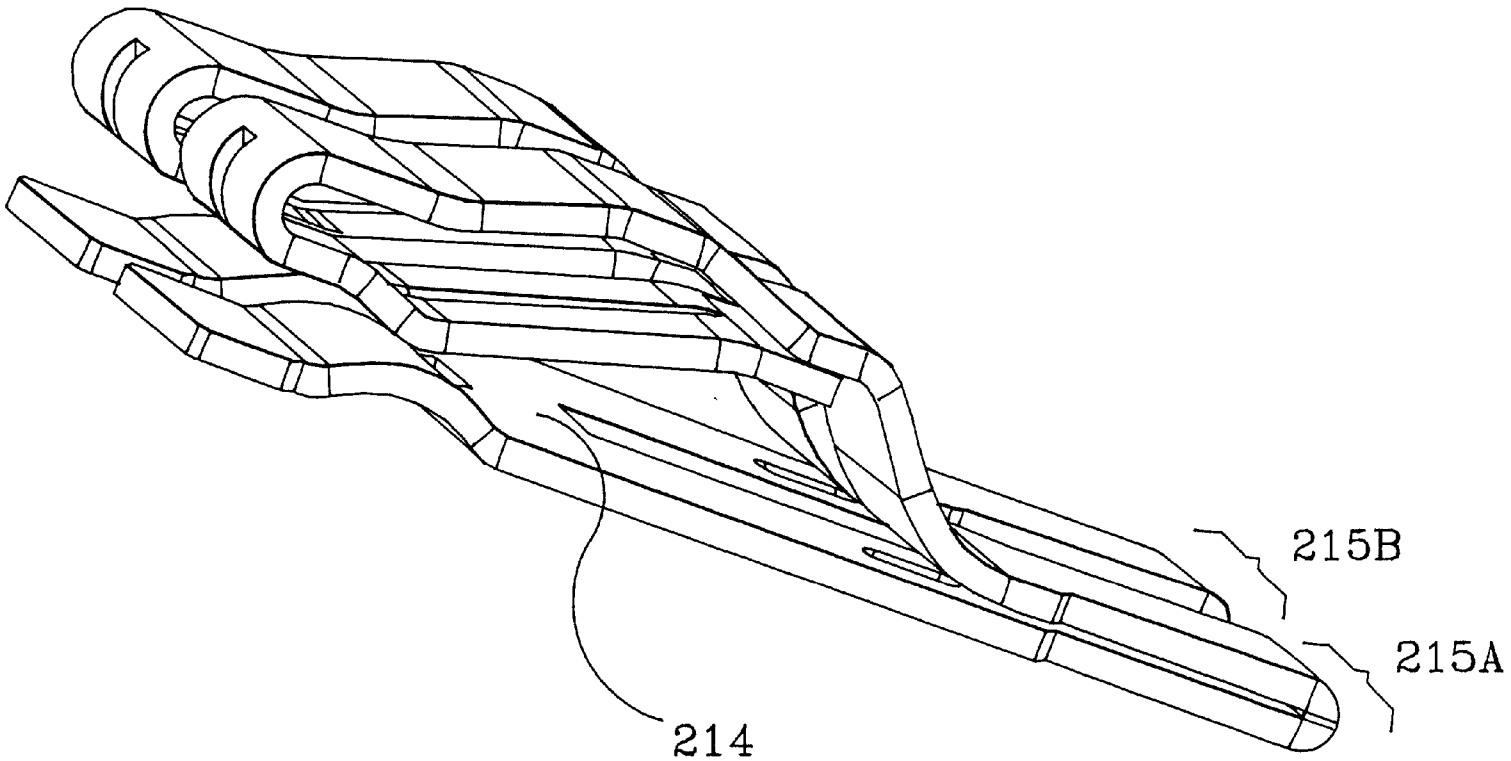
FIG. 9 is a perspective view of the foil contact according to the first preferred embodiment but with only two contact elements.
Figure 10:
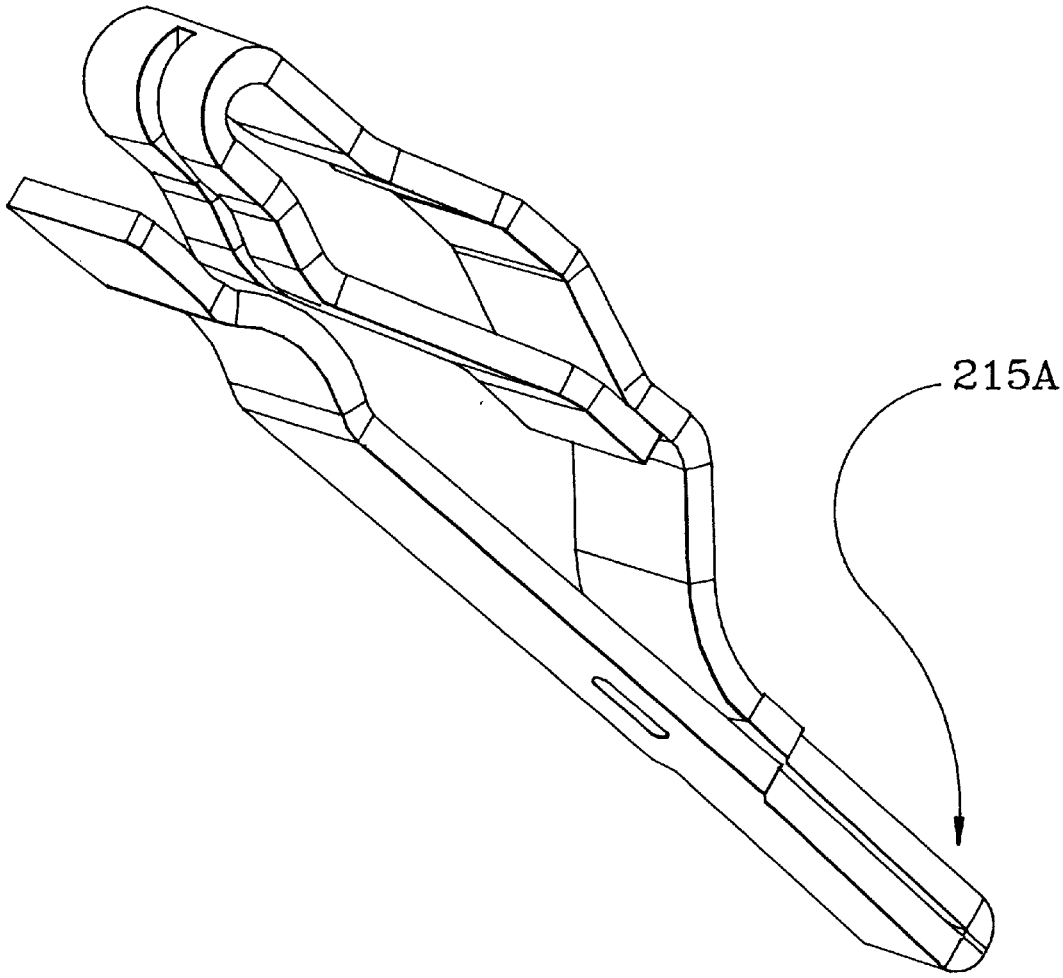
FIG. 10 is a perspective view of a single contact element of the foil contact according to the first preferred embodiment.

FIGS. 7 and 8 show in perspective view various views of the foil contact 106 according to the first preferred embodiment. FIG. 7 is a view before and FIG. 8 a view after removal of the punched eye strip 226. It can be seen that the foil contact 106 is composed of three contact elements 215A, B and C which are connected to one another via two contact bridges 214. If one of the two contact bridges are separated then the foil contact 106 shown in FIG. 9 is arrived at which now consists of only two contact elements 215A and 215B. If finally this last contact bridge 214 is also removed then the foil contact 106 now only consists of a single contact element 215A as shown in FIG. 10. The foil contact 106 can be adapted very easily to various printed conductor geometries and performance requirements owing to this separation of individual contact elements 215 from the foil contact 106.

Figure 11:
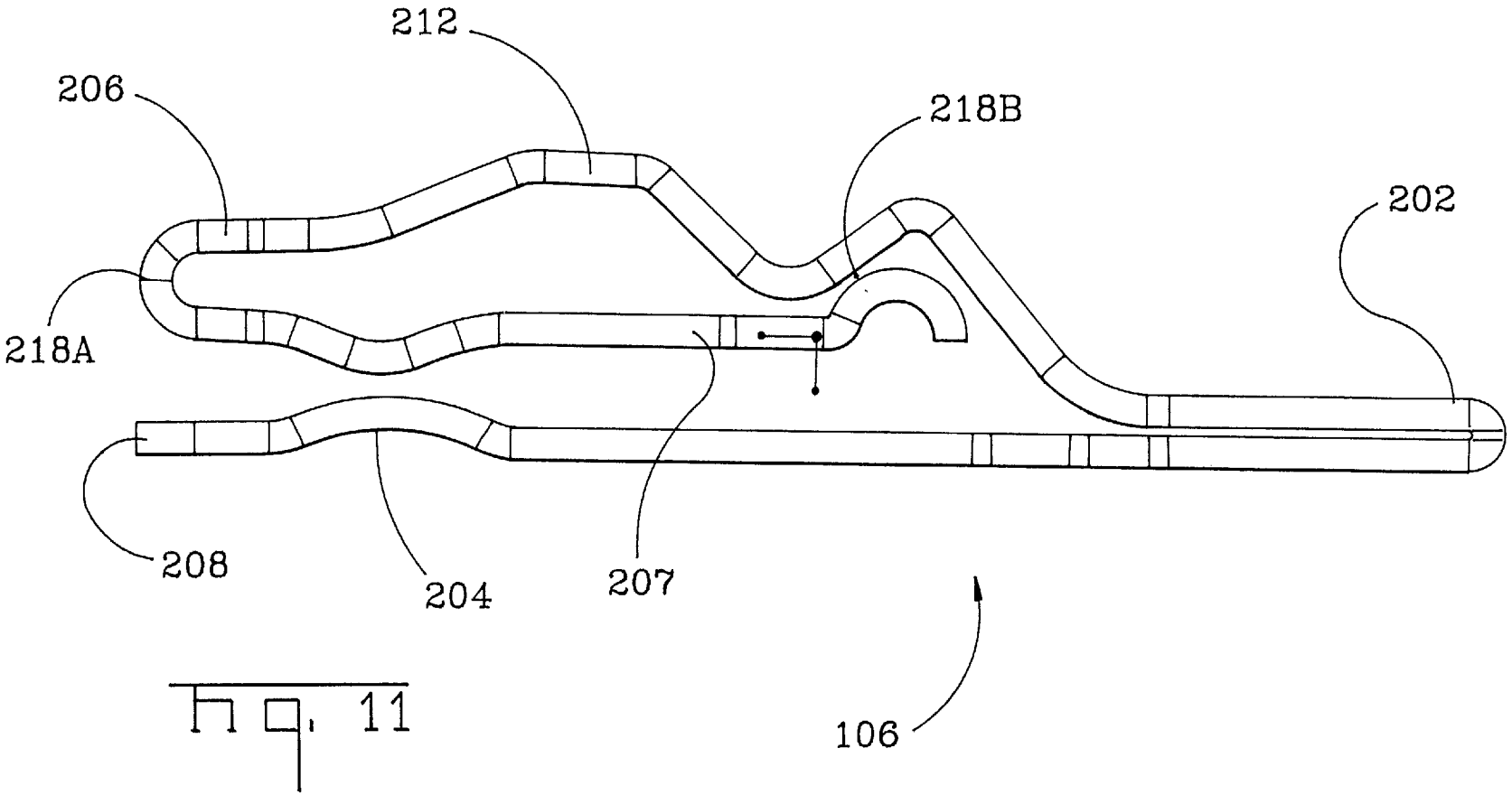
FIG. 11 is a section through a foil contact according to a second preferred embodiment.

FIG. 11 shows a second preferred embodiment of a foil contact 106 in which the outermost edge of the end section 207 of the first contact arm 206 is shaped in such a way that it comes into contact as a convex rounded piece with the first contact arm 206 and produces the second connecting point 218 if a mechanical pressure is exerted on the actuating zone 212. As in the previous embodiment the foil contact has a soldering zone in the connection region 202.

Figure 12:
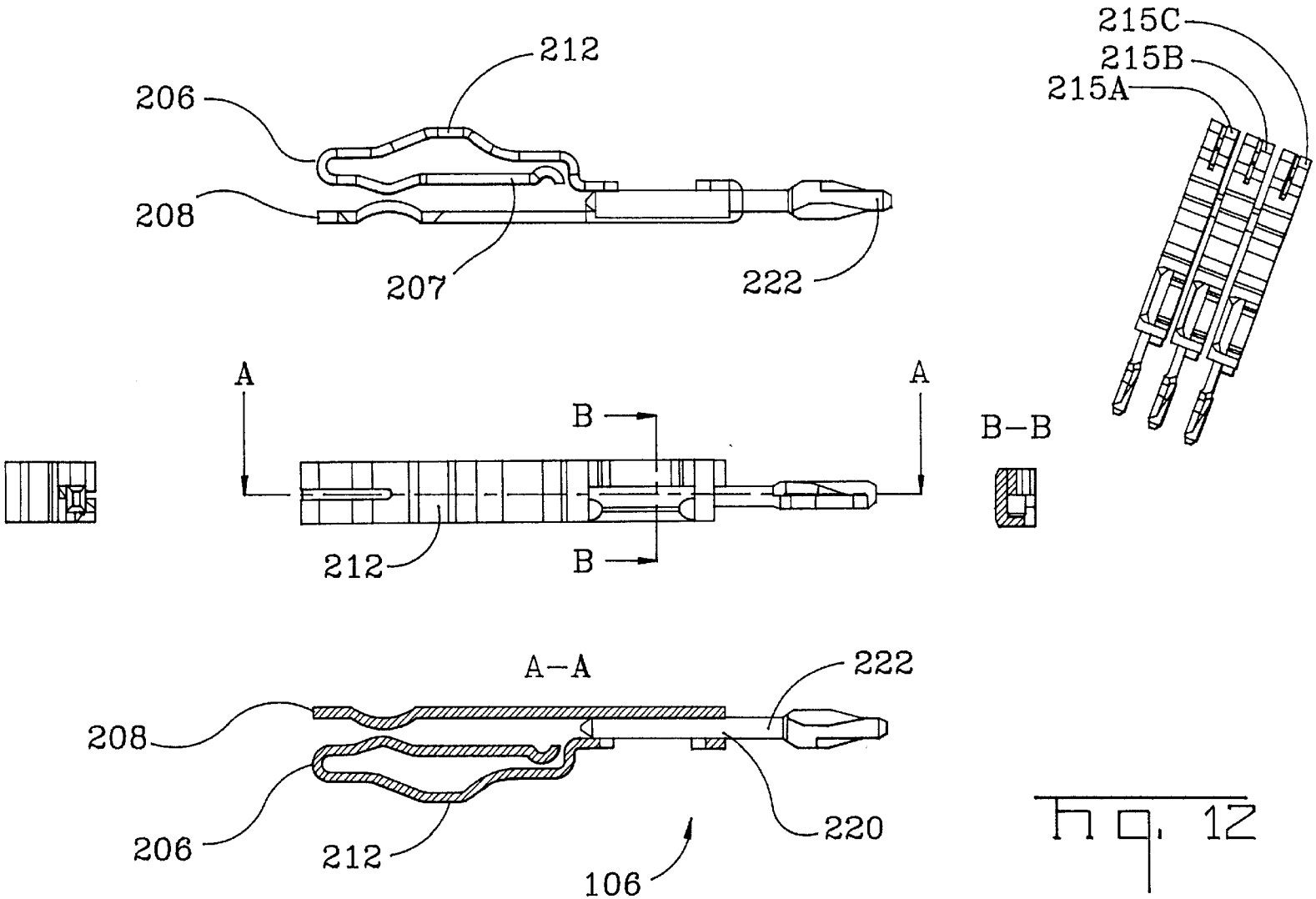
FIG. 12 shows various views of a foil contact according to a third preferred embodiment with inserted pin.

FIG. 12 shows a third preferred embodiment of the foil contact 106. As can be seen from the various views and sectional diagrams, the foil contacts 106 has an insertion aperture 220 into which a matching pin 222 is inserted. Therefore in this embodiment a socket can be connected to the connector as a further electronic component. This embodiment will be used wherever a detachable connection is required and therefore where soldered contacts are not an option. In addition, completely different pin designs can be used and great flexibility with regard to the connections to a further electronic component therefore achieved.

Figure 13:
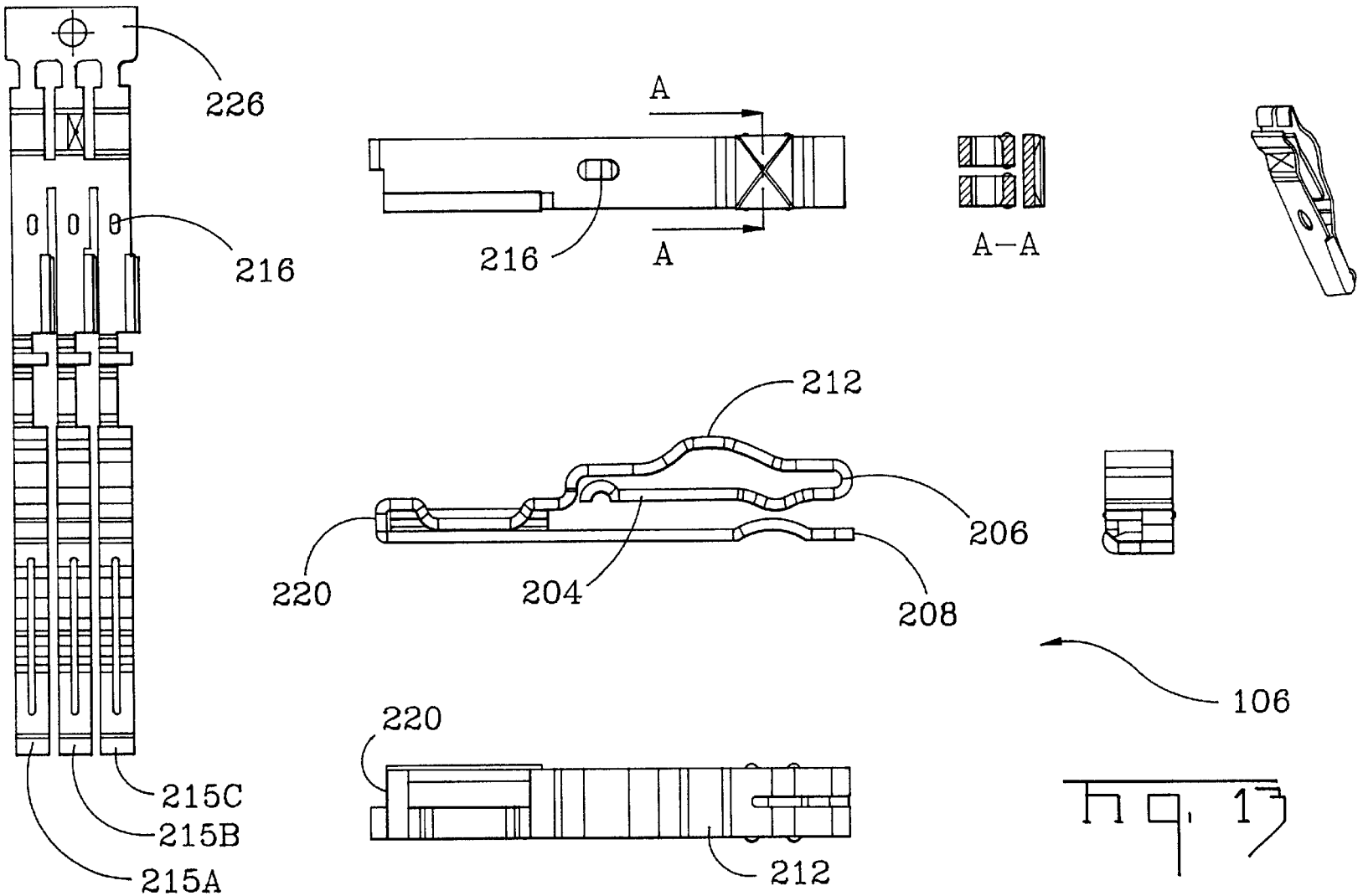
FIG. 13 shows various views of the foil contact according to the third preferred embodiment with removed pin.

FIG. 13 shows various views of the foil contact 106 without inserted pin 222 according to the present embodiment, in the bent and unbent state.

Figure 14:
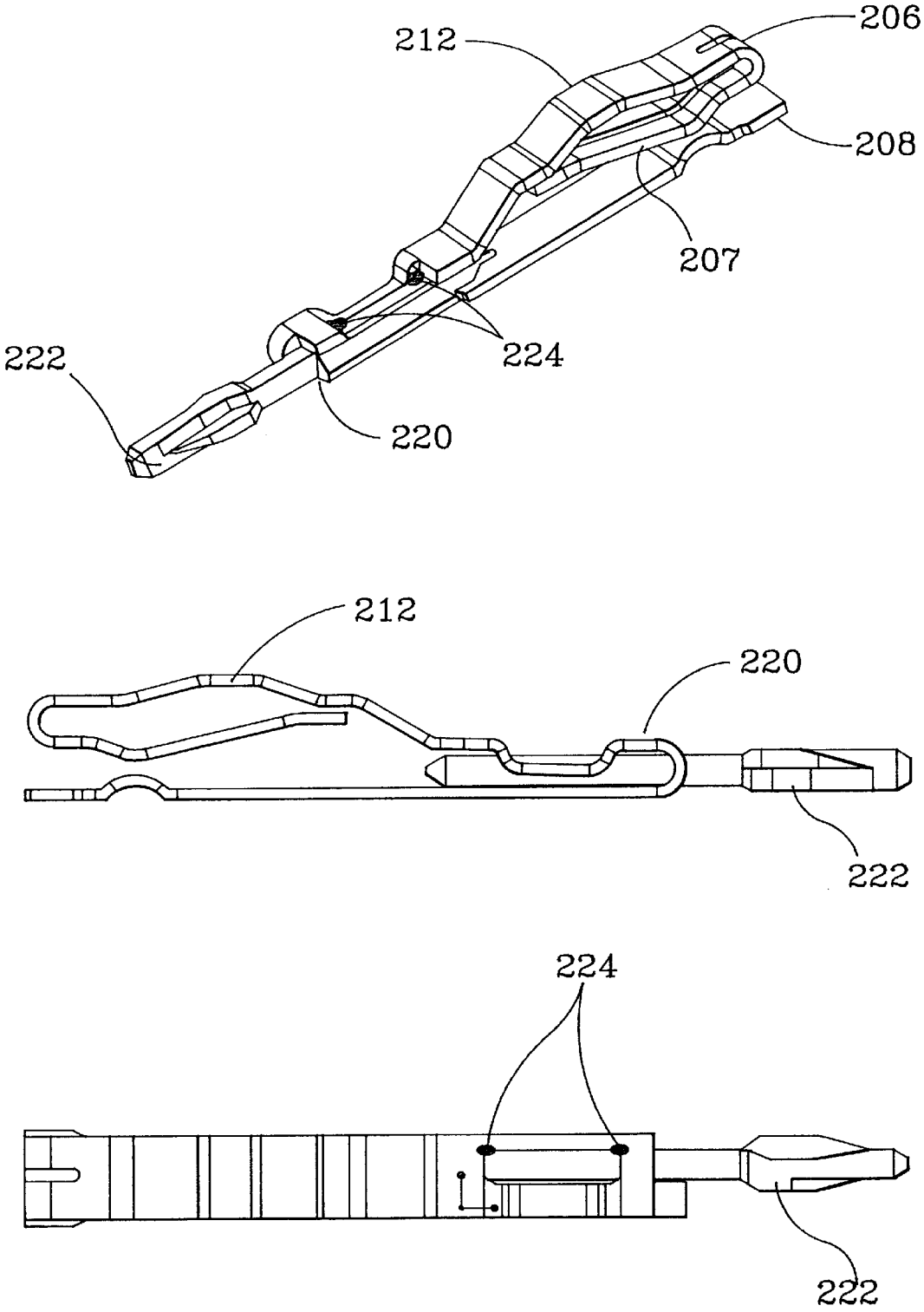
FIG. 14 is a single contact element of a foil contact according to a fourth preferred embodiment.

FIG. 14 shows various views as to how two laser weld points 224 are used to integrally secure the pin 222 in the foil contact 106 with the connection geometry according to the embodiment of FIGS. 12 and 13.

Figure 15:
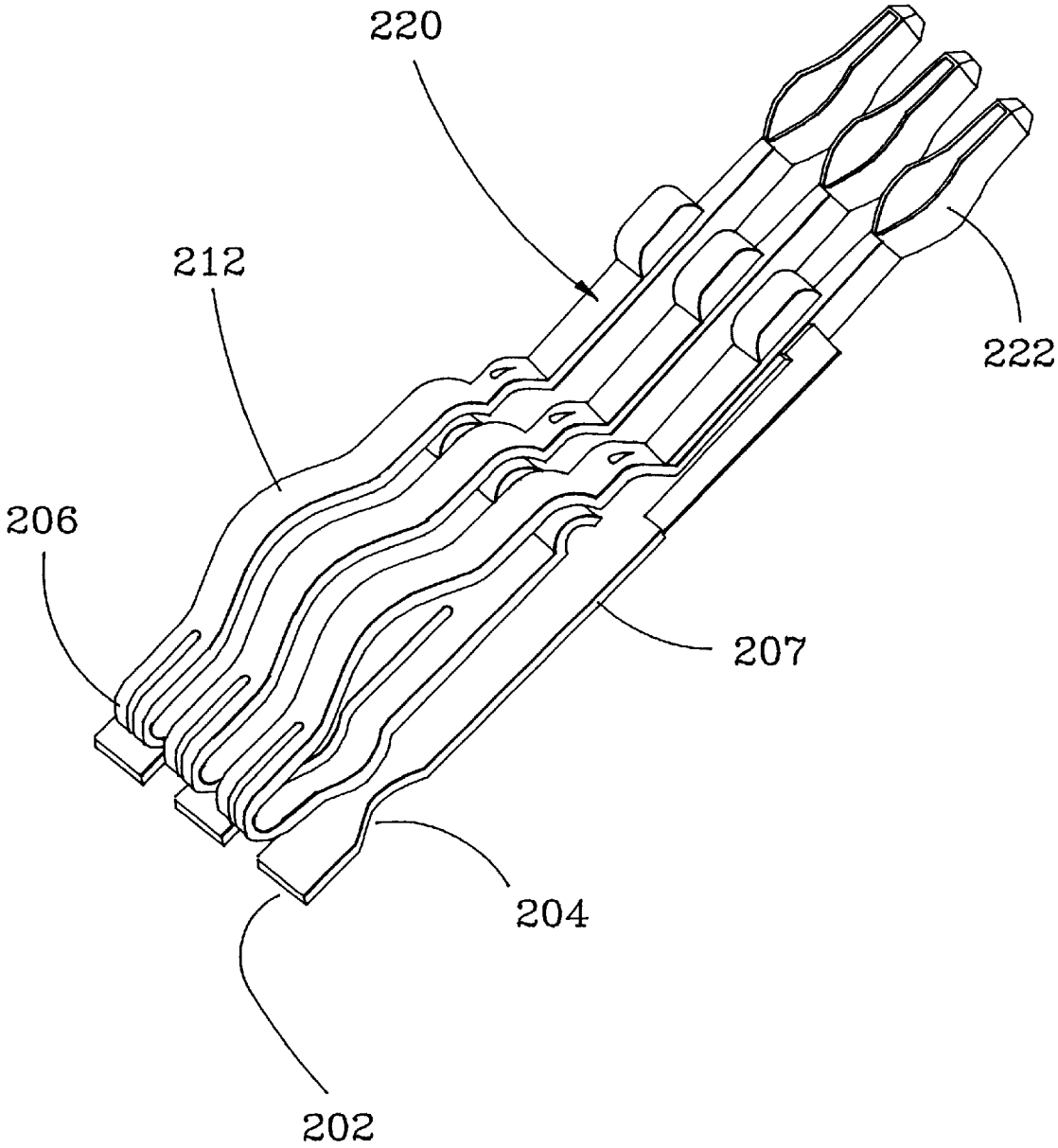
FIG. 15 is a perspective view of a foil contact according to a further preferred embodiment.

FIG. 15 shows that with the same embodiment of the insertion aperture 220 quite different types of pin 222 (here a so-called action pin) can be inserted.

Figures 16A, 16B:
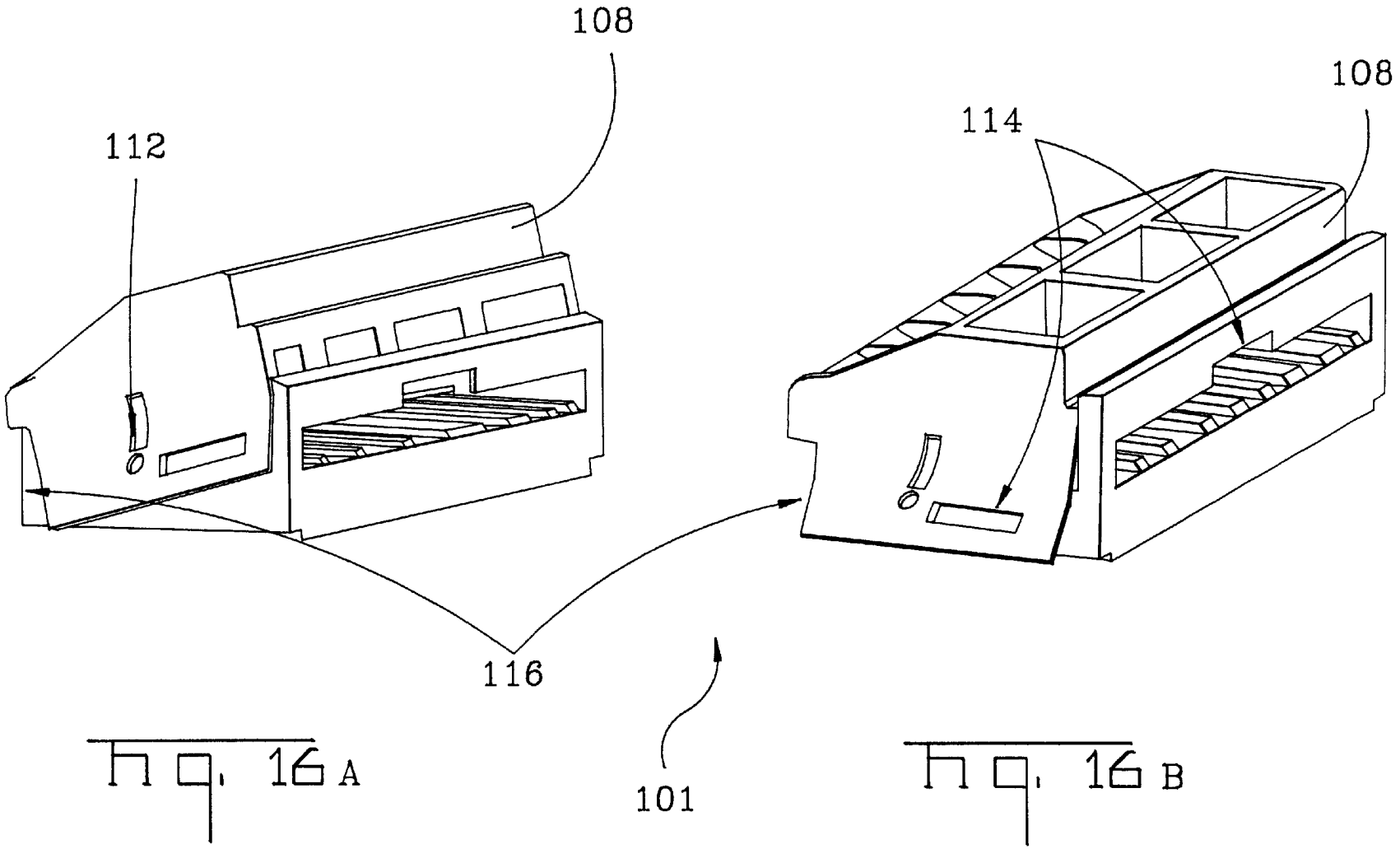
FIGS. 16A and 16B perspective views of the insulating housing in a preferred embodiment.

FIG. 16 shows the housing 101 according to the embodiment already shown in FIG. 1 in perspective view. FIG. 16A shows the open state in which the housing is ready for assembly and FIG. 16B the closed state. To ensure the actuator 108 remains in the ready for assembly position shown in FIG. 16A a first aperture 112 is provided on the actuator 108 in which a corresponding locking nose on the housing engages and secures the actuator in a ready for assembly pre-locking position. After assembly of the foil (the foil is not shown here) the actuator is folded down and corresponding locking noses of the housing engage in the second apertures 114 and fix the actuator in the final assembled position. To prevent the actuator from being closed too far and too firmly, a stop 116 is formed on the housing. With the aid of the stop 116 the exertion of excessive pressure forces on the foil contacts in the interior of the housing can be effectively prevented.

Figure 17B:
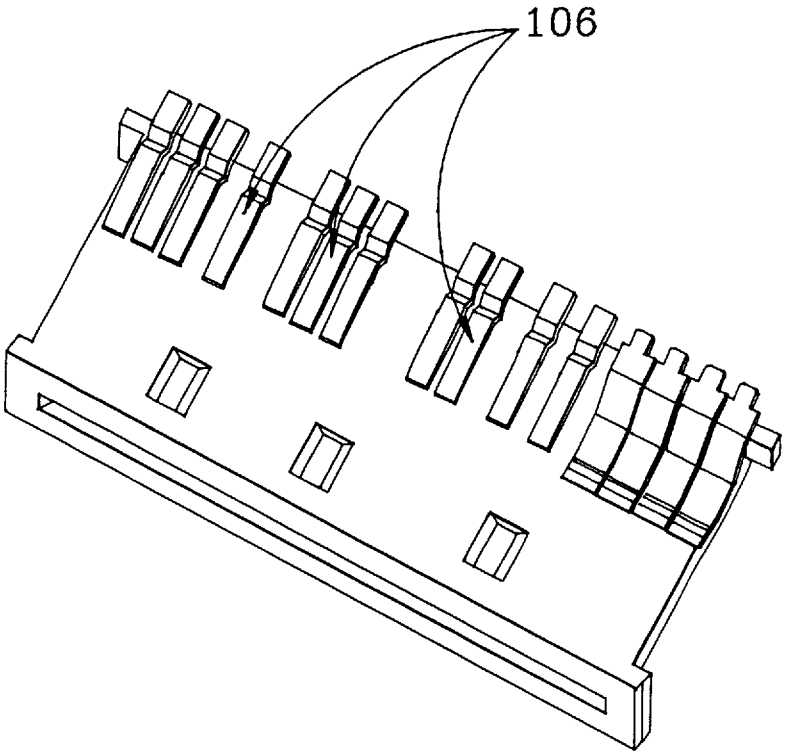
FIGS. 17A and 17B perspective views of a detail of the foil contact in the housing.
Figure 17A:
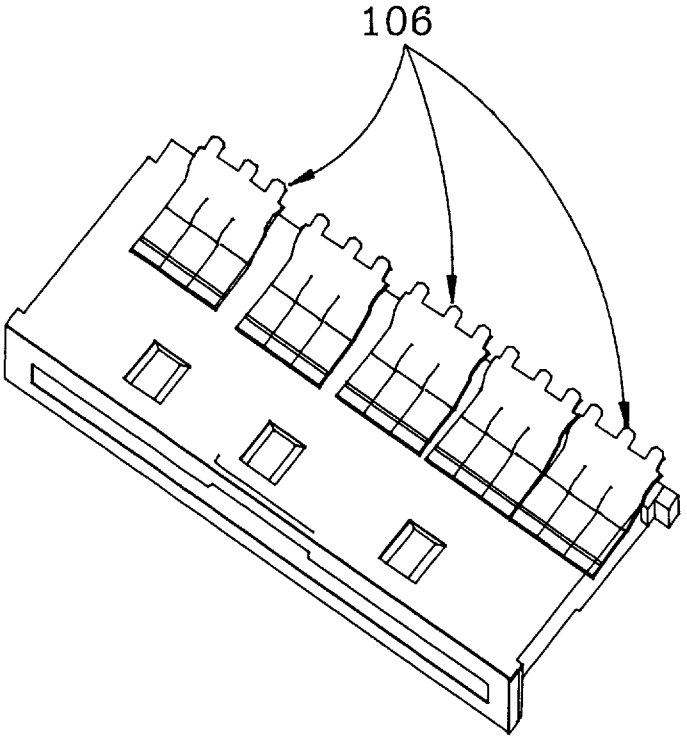

FIG. 17 shows a detailed view of the foil contact 106 in the housing. Two aspects of the invention are elucidated in FIGS. 17A and 17B: on the one hand, the foil contacts 106, as shown in FIG. 17A, can be inserted in varying number and position into the housing. As a result various foil widths can be taken into account. On the other hand, foil contacts 106 which consist of a differing number of contact elements 215 can be used in order to meet various performance requirements (see FIG. 17B).

Figure 18:
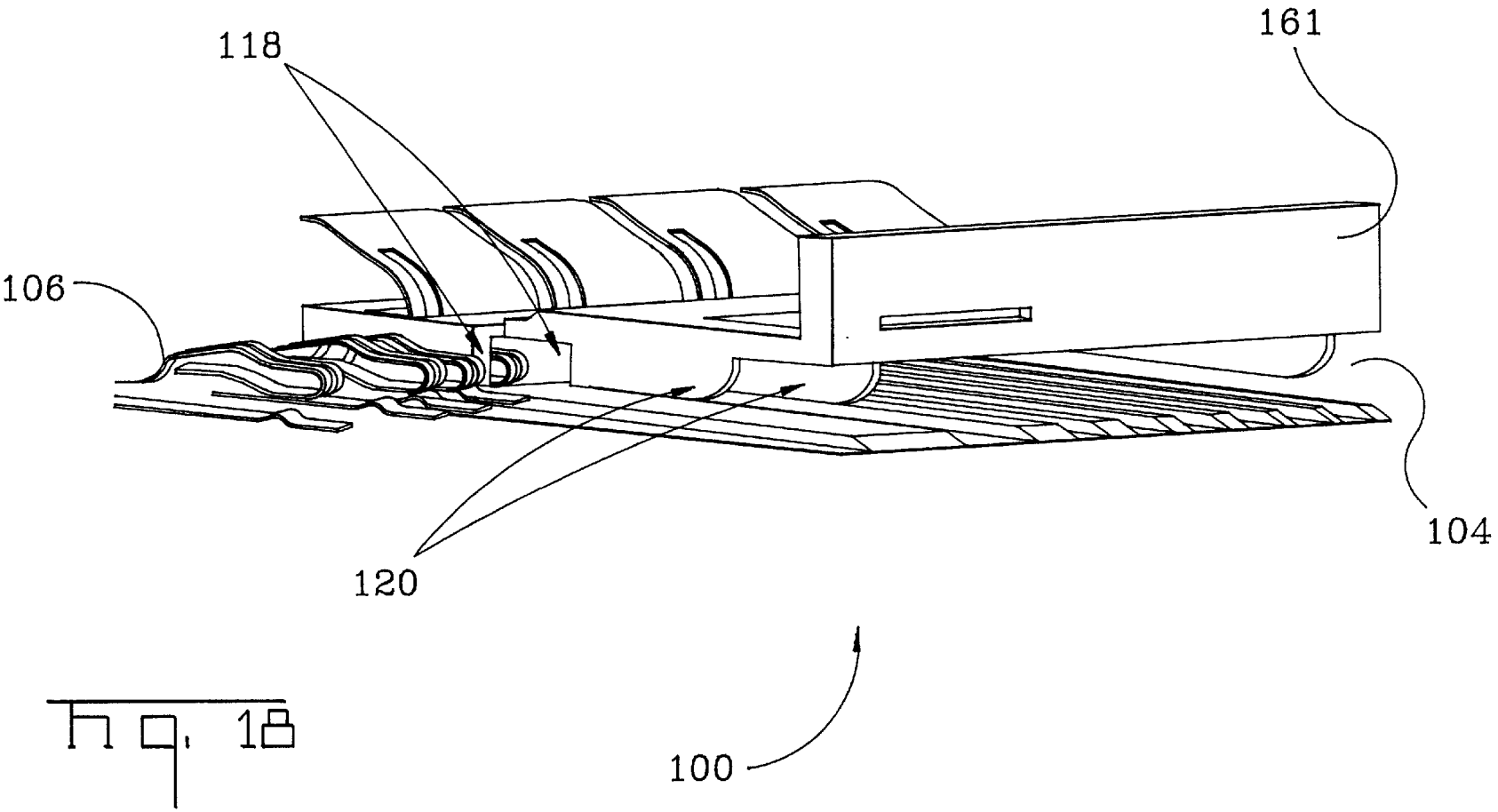
FIG. 18 is a perspective view of a detail of the foil contact in the housing.

FIG. 18 shows a further preferred embodiment of the present electrical connector. To ensure that no undulations are formed when the foil (not shown here) is introduced into the insertion aperture 104 and that the foil does not tilt, the support ribs 120 of the housing 101, which are required in order to impart mechanical stability to the housing, are shaped in such a way that they can function as insertion aids for the foil. It can also be seen from FIG. 18 that according to a preferred embodiment, separating webs 118 are formed in the housing which electrically insulate the foil contacts 106 from one another. Separating webs of this kind can, on the one hand, prevent electric breakdown between the foil contacts, on the other hand they serve to prevent cross talk between the individual foil contacts 106 via a capacitive coupling.

Figure 19:
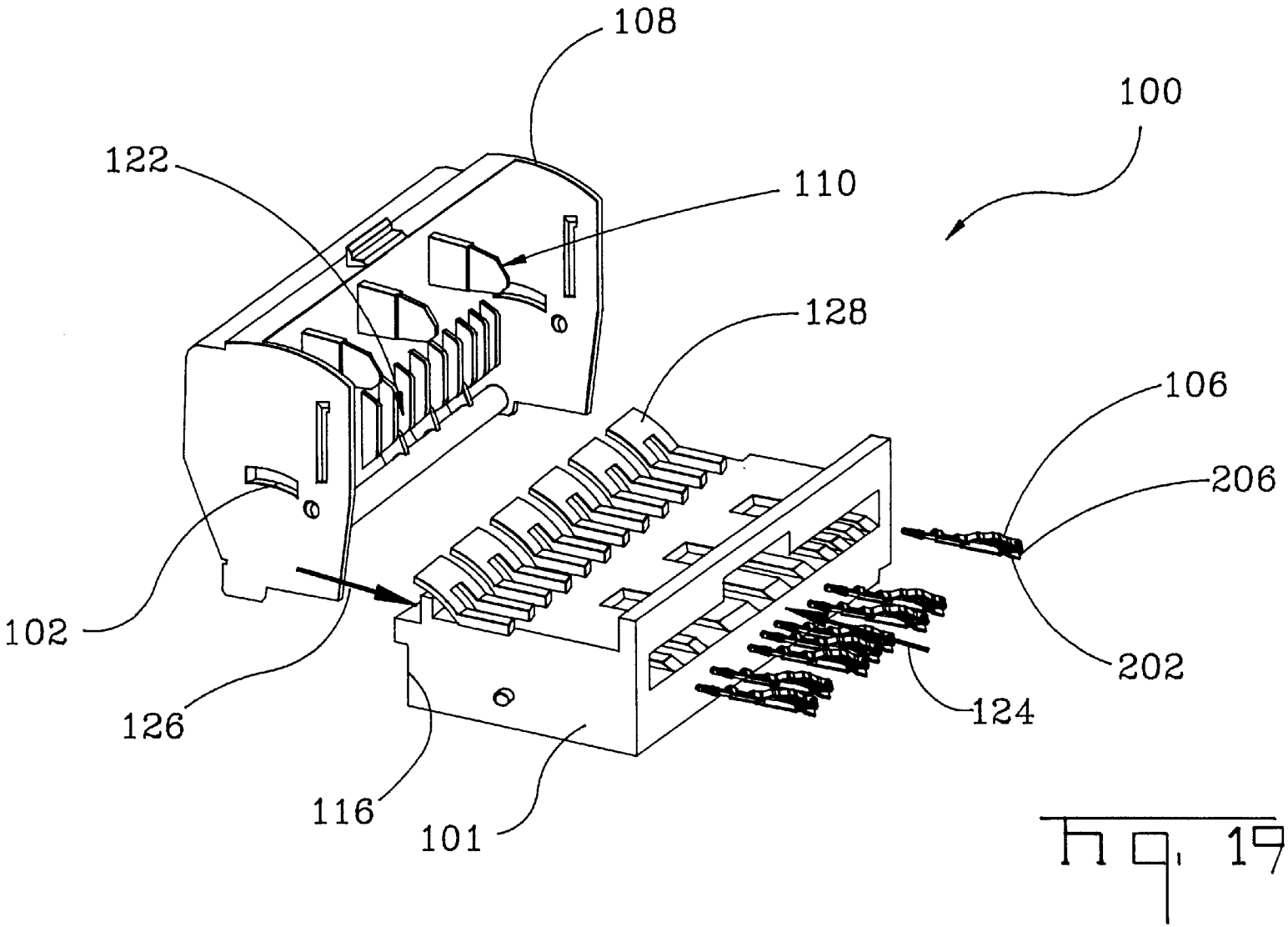
FIG. 19 is an exploded view of the housing with the foil contacts according to a first preferred embodiment.

FIG. 19 shows in an exploded view all components of the electrical connector for a foil with embedded flexible printed conductors. The individual assembly stages can be described with the aid of this drawing. The foil contacts 106 are inserted into the housing in the insertion direction 124 and latch via the apertures 216 (not visible) with the housing 101. The actuator 108 is snapped into the hinge 128 in the direction of the arrow designated 126. The actuator is then tilted downwards until the aperture 112 latches with the housing 101. In this position the connection 100 is ready to receive the foil. When the foil is inserted into the insertion aperture 104 and is positioned between the first and the second contact arm 206 and 208 of the foil contact 106 the latching 112 is released and the actuator 108 tilted downwards until it rests on the stop 116. At the same time the retaining webs 110 penetrate the foil without a pre-punched aperture being required for this purpose. The electric contact is now produced and the foil secured against withdrawal by the retaining web 110.

Figure 20B:
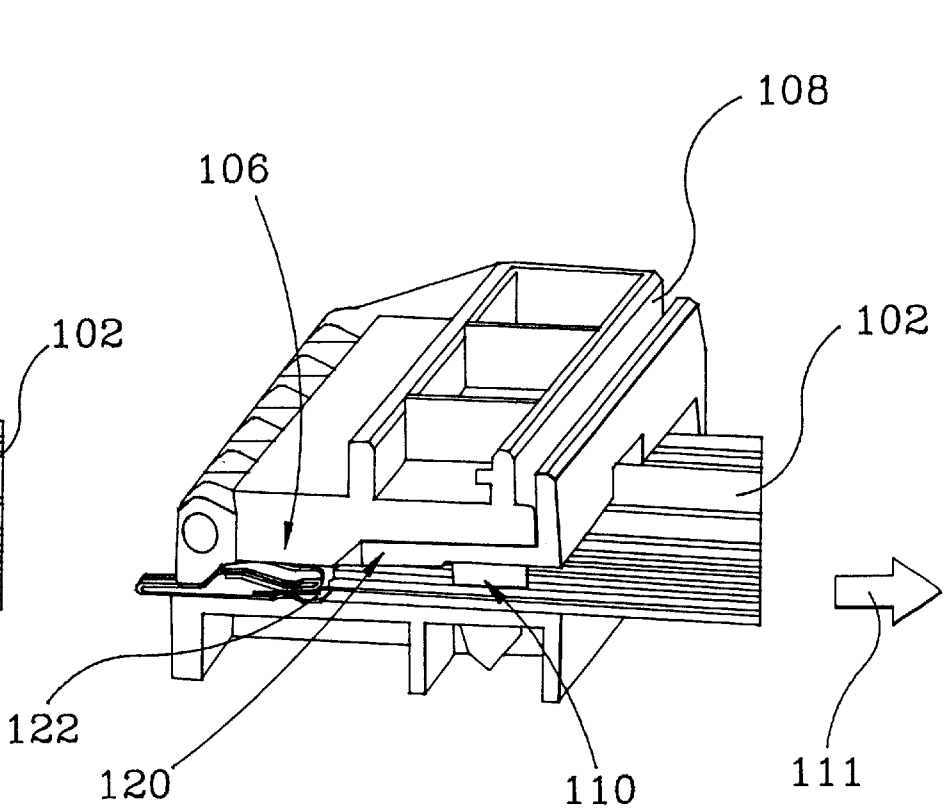
FIGS. 20A and 20B perspective views of the connector according to the invention during assembly and in the assembled state.
Figure 20A:
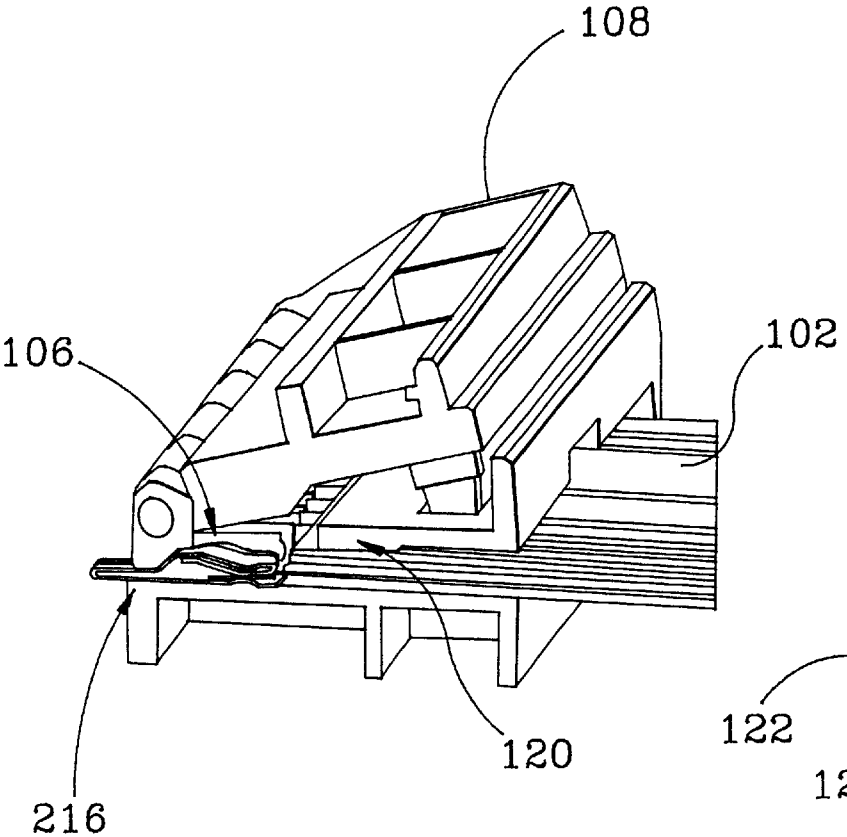

The closing procedure for the actuator 108 just described is also clear from FIGS. 20A and 20B. In the latching position shown in FIG. 20A the foil contacts 106 are relieved of pressure as they do not come into contact with the pressure webs 122. FIG. 20B shows how the foil contacts 106 are actuated by the pressure webs 122 and how the foil 102 is securely and reliably contacted in this way. The retaining webs 110 penetrate the foil and fix it in order to provide tension relief with respect to pressure on the foil in the direction 111.

Figure 21B:
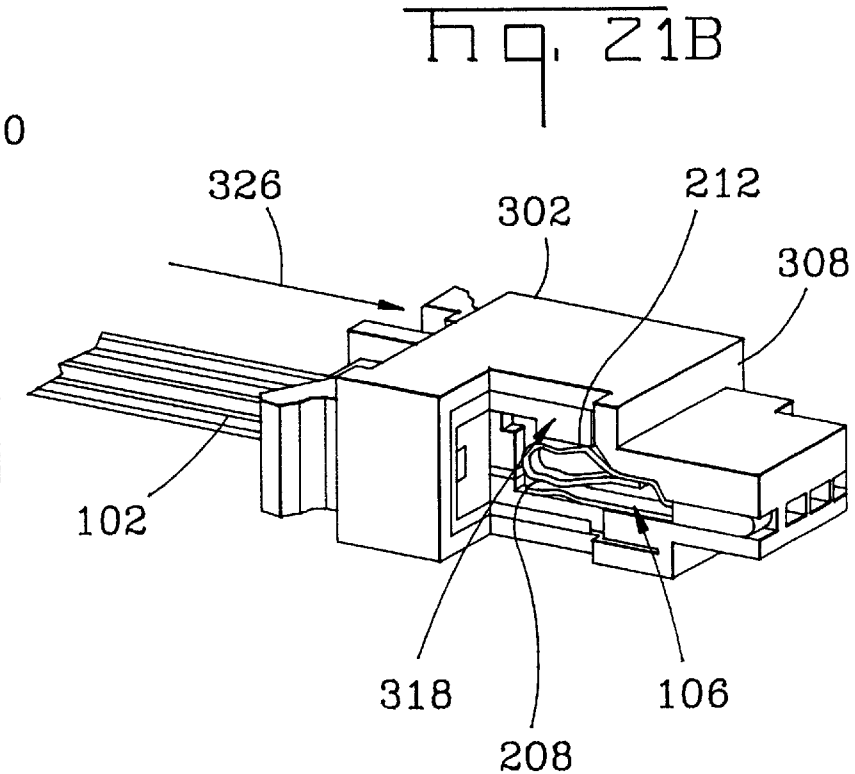
FIGS. 21A and 21B perspective views of the connector according to the invention in a further preferred embodiment, once during assembly and once in the assembled state.
Figure 21A:
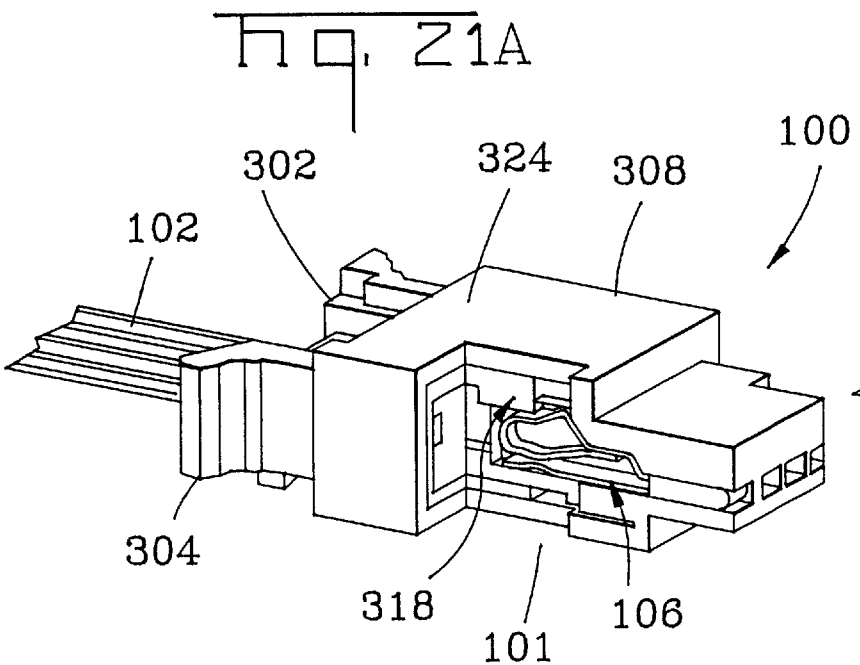

A further preferred embodiment of the electrical connector according to the invention is to be described with reference to FIG. 21. According to this preferred embodiment the housing 101 comprises a connector part 302 and a collar part 308 separated therefrom. The collar part 308 has a receiving aperture 324 for the connector part 302 in which the latter is inserted. The foil 102 is fixed in the connector part 302. The foil contacts 106 are mounted in the collar part 308 so upon insertion of the connector part 302 the foil is positioned between the first and second contact arm 206 and 208 of the foil contacts 106. The foil contacts 106 are actuated in this embodiment via a slide 304. If the slide 304 is inserted in the direction 326 into the collar part then the pressure web 318, which in FIG. 21 A still has no contact with the foil contact 106, slides over the actuating zone 212 of the foil contact 106 and exerts a pressure force thereon. As a result, the foil is electrically contacted by the foil contact. Therefore to actuate the foil contacts 106 an actuator no longer has to be tilted. All assembly stages can be carried out parallel to the arrow 326 by lateral movements and can therefore be more easily automated.

Figure 22B:
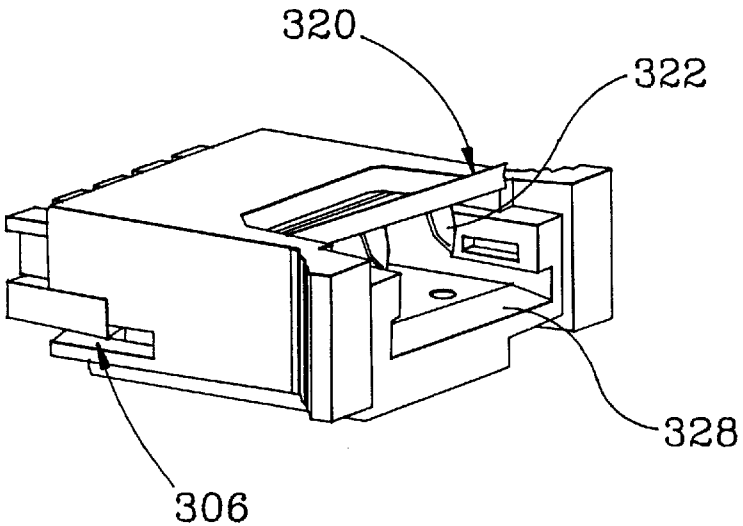
FIGS. 22A and 22B show two perspective views of the connector with and without inserted foil.
Figure 22A:
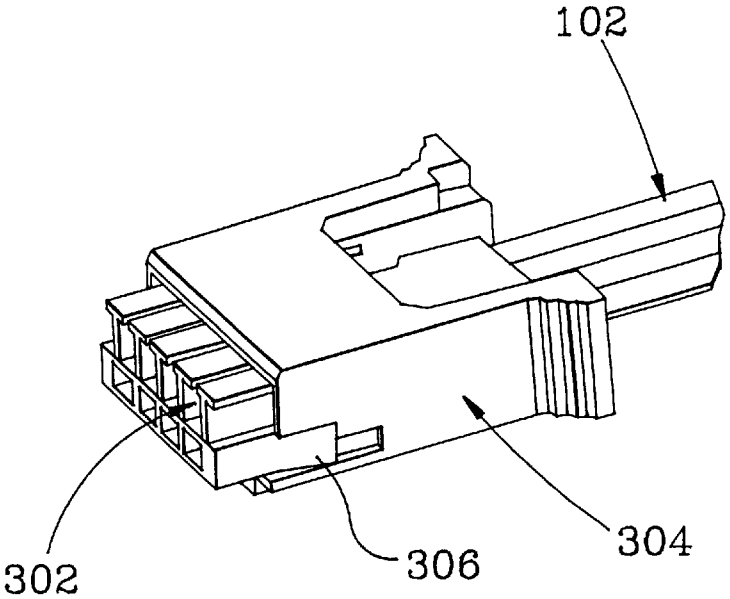
Figure 27:
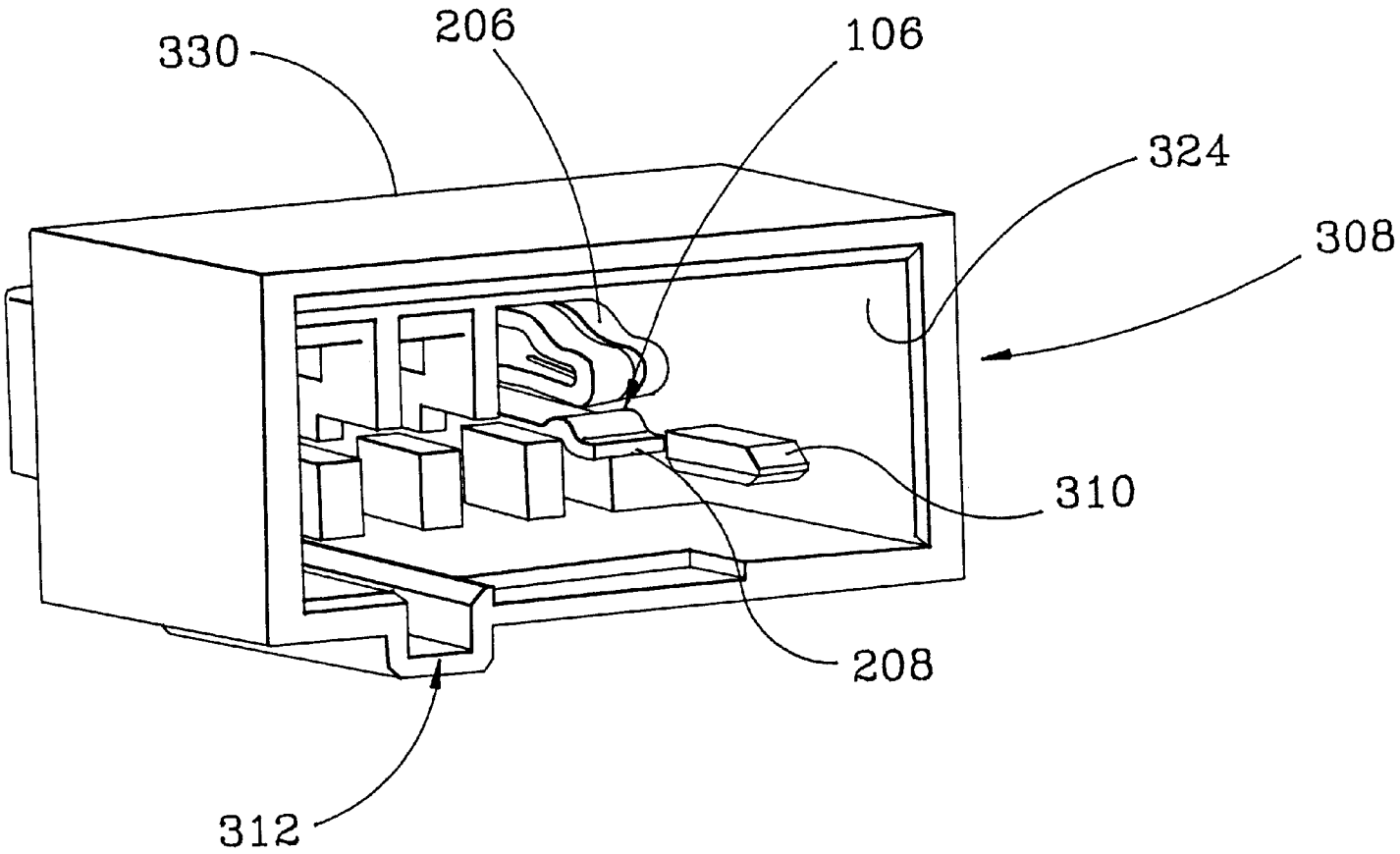

FIG. 22 shows the connector part 302 in two perspective views: FIGS. 22A and 22B. At the end face of the connector part, apertures in which the foil contacts mounted in the collar part are inserted when the housing is assembled can be seen. The slide 304 is located in the pushed back position and is secured in this position by the locking latch 306. As a result it is ensured that the slide cannot be pushed forward and be lost as long as the connector part 302 is not inserted in the collar part 308. FIG. 22B shows the insertion aperture 328 for the foil 102 in such a way that it is ready to receive the foil 102. A toggle 320 is open and retaining webs 322 can be seen which penetrate the inserted foil when the toggle 320 is folded down and guard the foil against tensile load without pre-punched apertures being required on the foil.

FIG. 23 shows in a perspective view the collar part 308. The foil connector 106 is mounted in this collar part in such a way that there is a sufficiently large gap between the first and second contact arm 206 and 208 in order to allow the foil, which is secured in the connector part, to be inserted without expenditure of force. A pressure web 310 which releases the locking latch 306 on the connector part 302 when the connector part is inserted into the collar part, so the slide is axially displaced, is located laterally in the receiving aperture for the connector part 324. Keying 312 ensures that the connector part 302 cannot be inserted into the wrong side of the collar part 308.

Figures 24A, 24B:
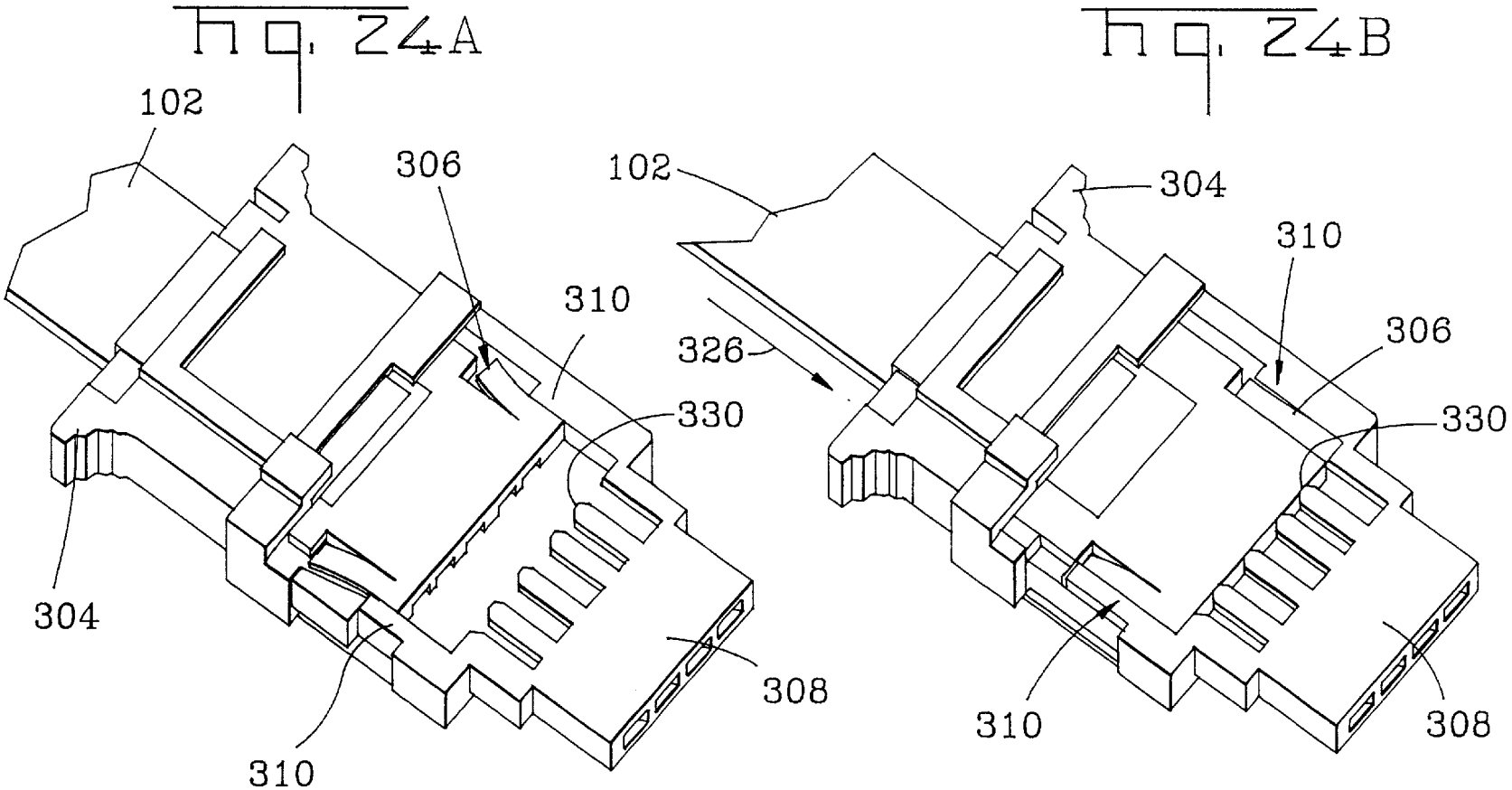
FIGS. 24A and 24B show two perspective views of the connector according to the invention during assembly and in the assembled state (partially cut open)

FIGS. 24A and 24B show the connection of connector part 302 and collar part 308. In this perspective view the collar part 308 is shown open. As can be seen in FIG. 24A the connector part 302 is inserted into the receiving aperture 324 of the collar part. The slide 304 is secured by the locking latch 306 in the process. If the slide 302 is now inserted into the collar part 308, as shown in FIG. 24B, up to the stops 330 then the locking latch 306 is released by the pressure web 310 and the slide 304 can be displaced in the direction 326. This ensures that the contacts can only be actuated with the aid of the pressure web 310 after the foil has been fully inserted.

Figure 25:
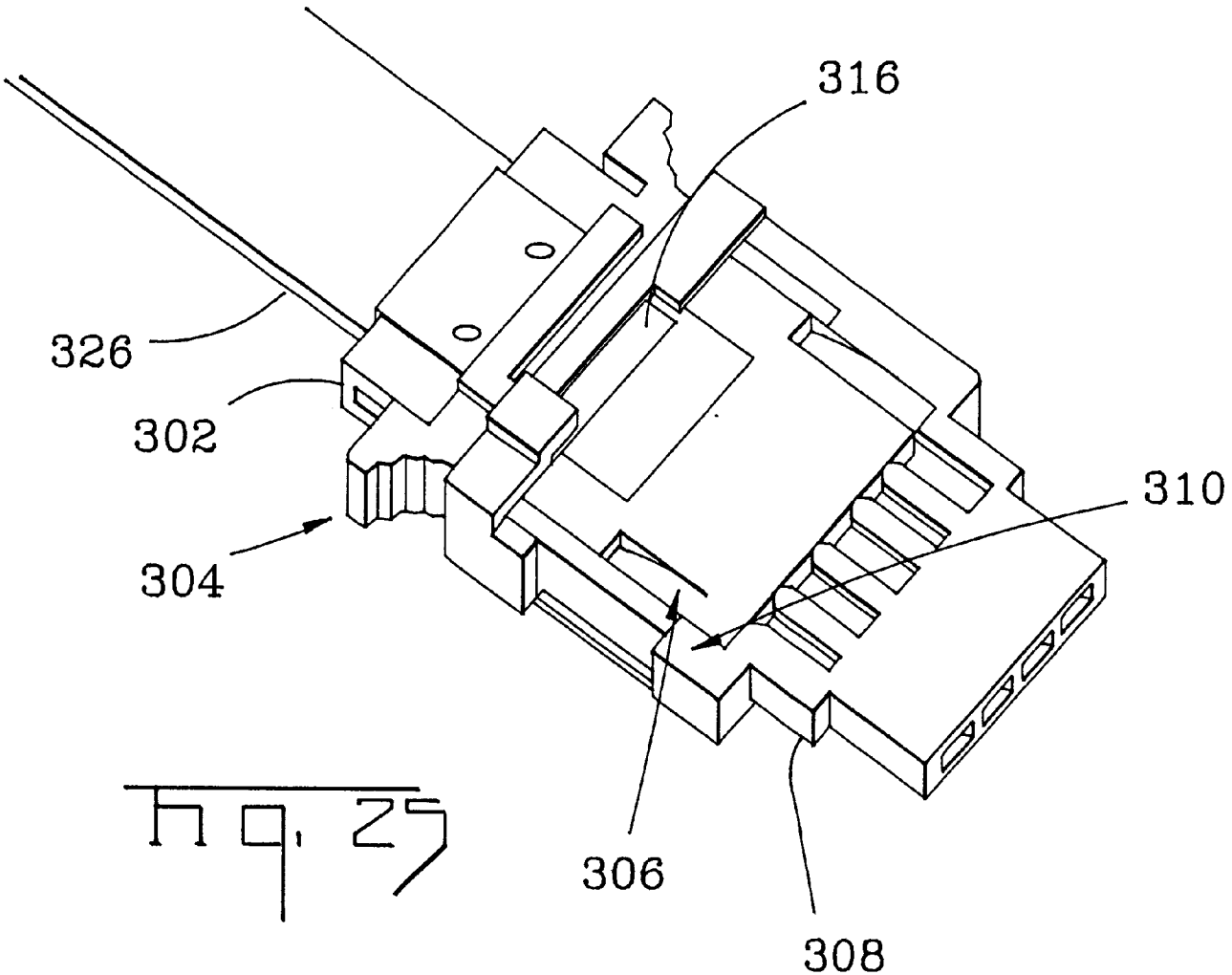
FIG. 25 is a perspective view of the connector according to the invention in the assembled state (collar part shown partially open).

FIG. 25 shows the final operating step, namely actuation of the foil contacts 106 by moving the slide 304 in the direction 326. The collar part 308 is shown open in this case as well. The slide is fixed in its final position on the collar part via a locking latch 316. The connector 100 is therefore fully assembled and can be connected to a further electronic component.

An advantage of the electrical connector according to the invention is that, because of the specific geometry of the foil contact, the normal contact force can be adjusted within comparatively large ranges. As the spring steel permits relatively large deflections of the contact arms, various foil thicknesses can be combined with the same connector. As the pressure force, which acts on the actuating region, directed substantially perpendicularly to the foil face is separated in the contact section into one normal and one parallel component, owing to its forwarding via the end section of the first contact arm bent approximately into a U-shape, the contact section of the first contact arm rubs on the printed conductor of the foil when the foil contact is actuated and in this way removes any potential residues impairing electric contact. Furthermore, producing the foil contacts from a punched or bent spring sheet is a particularly inexpensive method of production. In the configuration according to the invention the foil contact moreover forms a double spring which makes an open gap size and a constant spring characteristic curve possible.

In order to be able to adapt the foil contacts in terms of their capacity adaptation at minimum production cost, the foil contacts can be composed of a plurality of contact elements which can be connected to one another by separable contact bridges.

According to a preferred embodiment the foil contacts have apertures in which a matching securing locking latch snaps when installed in the housing. This allows completely automatic loading of the housing with the foil contact.

The subdivision of the first contact arm via a slot into two contact webs reduces the mating forces. Low mating forces are required in order to prevent undulations forming and to prevent the foil from tilting. Furthermore, this design facilitates a good contact with the printed conductors of the foil.

According to a preferred embodiment the connecting zone is designed as a soldered connection, so the electrical connector according to the invention is suitable for applications in which it has to be soldered on.

If, on the other hand, the foil contact is provided with an insertion funnel in which a pin is inserted the connector can be adapted to various types of connection, such as action pin 90° and 180°, SMD connection etc.

Connection of the pin to the insertion funnel via a laser weld point or mechanical closing mechanisms with non-positive fit can prevent the pin from being unintentionally displaced axially.

The fundamental advantage of this electrical connector according to the invention is that the tension relief of the foil is achieved in a single operation with pressing-on of the foil contacts by displacing the actuator. In this way the number of components as well as the required assembly time can be kept low.

According to a preferred embodiment the actuator comprises at least one aperture in which a corresponding locking latch of the housing snaps and fixes the actuator in a pre-locking position in which the foil contacts are open. In this way it can be ensured that the electrical connector is immediately ready for assembly when delivered.

A second aperture provided according to a preferred embodiment in which a corresponding second locking latch of the housing engages, fixes the actuator in its end position. A simple and straightforward assembly of the housing components can be ensured owing to this mechanical locking.

If partition plates are provided on the housing which electrically insulate the foil contacts from one another, then this has the advantage that both the dielectric strength is increased and capacitive coupling between adjacent contacts, which adversely manifests itself as increased cross talk, can be prevented.

The configuration of the support ribs stabilising the housing as insertion aids for the foil is particularly advantageous as clean guidance of the foil in the housing and therefore reliable and confusion-free contacting is ensured in this way.

The connector according to the invention offers the advantage of contacting which is particularly advantageous economically and is mechanically secure.

Actuation of the foil contacts using a slide offers the advantage that the foil contacts can be actuated by a lateral movement and therefore this production stage is more easily automated.

If the retaining elements for the foil are designed as retaining webs which are formed as one piece on a pivotally mounted toggle, particularly secure fixing of the foil is achieved without prior punching thereof.

According to a preferred embodiment the slide is secured on the connector part by a locking latch so it is ensured that the connector part is already ready for assembly upon delivery.

If it is provided that the first locking latch which locks the slide in a pre-locking position is reliably released by a pressure web on the collar part, it is ensured that the foil contacts are only actuated when the foil is optimally positioned. In this way faulty contacts can largely be avoided.

According to a further preferred embodiment the slide has a second locking latch which engages in a groove on the housing. As a result reliable contacting of the foil which cannot be unintentionally broken is ensured.

What is claimed is:

1. An electrical connector to at least partially receive a foil with flexible printed conductors embedded therein, the connector comprising:

an insulating housing with an insertion aperture for the foil;

at least one foil contact with a contact section for contacting the printed conductors;

a connecting zone for connection to an electric component; and, an actuating zone to receive mechanical pressure;

wherein the foil contact is bent as one piece from a punched spring sheet, at least one first contact arm and one second contact arm being formed which oppose one another and between which the foil can be inserted and contacted in the contact section and the first contact arm comprising an end section which is bent approximately to a U-form, which can be brought into contact with the two contact arms owing to pressure exerted on the actuating zone that vertically and horizontally displaces the end section in respect to the second contact arm, so the foil is held between the end section and the second contact arm.

2. The electrical connector according to claim 1, wherein the foil contact is formed from a plurality of contact elements which are connected to one another by separable contact bridges.

3. The electrical connector according to claim 2, wherein the foil contact comprises at least one aperture into which a matching securing locking latch can be snapped when being installed in the housing.

4. The electrical connector according to claim 3, wherein at least one of the contact arms has a slot in the contact section, whereby two contact webs respectively are formed.

5. The electrical connector according to claim 4, wherein the connecting zone is designed as a soldered connection.

6. The electrical connector according to claim 4, wherein the connecting zone comprises an insertion funnel in which a pin is inserted.

7. The electrical connector according to claim 6, wherein the pin is connected by at least one laser weld point to the insertion funnel.

8. An electrical connector to a least partially receive a foil with flexible printed conductors embedded therein, the connector comprising:

an insulating housing with an insertion aperture for the foil;

at least one foil contact with a contact section for contacting the printed conductors;

a connecting zone for connection to an electric component;

an actuator for actuating the foil contact, the actuator having at least one first aperture in which a corresponding locking nose of the housing can be locked and fixes the actuator in a pre-locking position; and, retaining webs which penetrate the foil when the actuator is closed being integrally moulded onto the actuator.

9. The electrical connector according to claim 8, wherein the housing includes a stop that engages the actuator when the actuator is in its end position.

10. The electrical connector according to claim 8, wherein the actuator comprises at least one second aperture in which a corresponding second locking nose of the housing can be locked and fixes the actuator in its end position.

11. The electrical connector according to claim 10, wherein the foil contacts are electrically insulated from one another by partition plates formed on the housing.

12. The electrical connector according to claim 11, wherein the housing comprises support ribs to increase the mechanical stability, which ribs are simultaneously designed as insertion aids for the foil.

13. An electrical connector to at least partially receive a foil with flexible printed conductors embedded therein, the connector comprising:

at least one foil contact with a contact section for contacting the printed conductors;

a connecting zone for connection to an electric component and an actuating zone to receive mechanical pressure; and, an insulating housing having a connector part with an insertion aperture for the foil and a collar part separated therefrom, the collar part having a receiving aperture for the connector part, the at least one foil contact being mounted in the collar part and retaining elements for the foil being formed in the connector part.

14. The electrical connector according to claim 13, wherein the collar part has keying so that the connector part is properly received in the collar part.

15. The electrical connector according to claim 13, wherein the connector part also comprises a slide on which at least one pressure web is formed to actuate the foil contacts.

16. The electrical connector according to claim 15, wherein the retaining elements are formed as one piece on a retaining web formed on a toggle, the toggle being pivotally mounted on the connector part and the retaining webs penetrating the foil when the toggle is pressed down.

17. The electrical connector according to claim 16, wherein the connector part comprises at least one locking latch for locking to the slide.

18. The electrical connector according to claim 17, wherein the collar part comprises a pressure web which unlocks the first locking latch to allow movement of the slide in the axial direction, when the connector part is assembled in the collar part.

19. The electrical connector according to claim 18, wherein the slide comprises at least two locking latches which can lock in a groove on the housing.

* * * * *